US011440162B2

(12) United States Patent
Griffin et al.

(10) Patent No.: US 11,440,162 B2
(45) Date of Patent: Sep. 13, 2022

(54) APPARATUS AND METHOD FOR SEPARATING REUSABLE ABRASIVE MEDIA FROM NON-REUSABLE MEDIA

(71) Applicant: BLAST GURU LLC, Woodstock, GA (US)

(72) Inventors: Stan Griffin, Woodstock, GA (US); Joe Craig, Woodstock, GA (US)

(73) Assignee: Blastec, Inc., Alpharetta, GA (US)

( * ) Notice: Subject to any disclaimer, the term of this patent is extended or adjusted under 35 U.S.C. 154(b) by 411 days.

(21) Appl. No.: 16/592,752

(22) Filed: Oct. 3, 2019

(65) Prior Publication Data

US 2020/0108486 A1 Apr. 9, 2020

Related U.S. Application Data

(60) Provisional application No. 62/740,825, filed on Oct. 3, 2018.

(51) Int. Cl.
*B24C 9/00* (2006.01)
*B07B 13/16* (2006.01)
(Continued)

(52) U.S. Cl.
CPC ..... *B24C 9/006* (2013.01); *B07B 1/42* (2013.01); *B07B 13/05* (2013.01); *B07B 13/16* (2013.01); *B24C 1/10* (2013.01)

(58) Field of Classification Search
CPC .. B24C 9/006; B24C 1/10; B07B 1/42; B07B 13/05; B07B 13/16
(Continued)

(56) References Cited

U.S. PATENT DOCUMENTS 3,279,125 A 10/1966 Leliaert
3,539,117 A 11/1970 Sjogren
(Continued)

FOREIGN PATENT DOCUMENTS

CN 106824405 A * 6/2017
WO 9749525 A1 12/1997

OTHER PUBLICATIONS

International Search Report and Written Opinion dated Jan. 31, 2020 cited in Application No. PCT/US2019/054593, 11 pgs.

*Primary Examiner* — Terrell H Matthews
(74) *Attorney, Agent, or Firm* — Bekiares Eliezer LLP

(57) ABSTRACT

Disclosed herein are an apparatus and system for separating reusable abrasive media from non-reusable media. The system for separating reusable abrasive media from non-reusable media having a housing defining an enclosure and being configured for further separating previously sorted and discarded abrasive media, the shot peening efficiency system operating via the housing comprising: a symmetrically bisected housing having a left housing component and a right housing component having an angled opening configured to receive an abrasive media inlet valve wherein the left housing component and the right housing component are connected via one or more fasteners; wherein the symmetrically bisected housing is deep set at the left housing component and the right housing component in a manner configured to accept a separator assembly comprising at least one wire mesh screen, at least one vibratory motor, and one or more mounting hardware components. Also disclosed are methods of using apparatus and system.

13 Claims, 15 Drawing Sheets

(51) Int. Cl.

| | |
|---|---|
| ***B24C 1/10*** | (2006.01) |
| ***B07B 1/42*** | (2006.01) |
| ***B07B 13/05*** | (2006.01) |

(58) Field of Classification Search
USPC ..... 451/88
See application file for complete search history.

(56) References Cited

U.S. PATENT DOCUMENTS

| | | | | |
|---|---|---|---|---|
| 3,802,916 | A | 4/1974 | Jackson | |
| 4,319,993 | A | 3/1982 | Krause | |
| 4,394,256 | A | 7/1983 | Goff | |
| 4,771,579 | A | 9/1988 | Giese | |
| 4,832,706 | A | 5/1989 | Yates | |
| 5,024,029 | A | 6/1991 | Abbott et al. | |
| 5,177,911 | A * | 1/1993 | Ruemelin | B24C 9/00 451/6 |
| 5,231,804 | A | 8/1993 | Abbott | |
| 5,269,424 | A | 12/1993 | Lyras | |
| 5,431,287 | A | 7/1995 | Knox | |
| 5,596,912 | A | 1/1997 | Laurence et al. | |
| 5,637,029 | A | 6/1997 | Lehane | |
| 5,915,566 | A | 6/1999 | Senapati | |
| 6,190,235 | B1 | 2/2001 | Csabai et al. | |
| 6,514,128 | B1 * | 2/2003 | Lyras | B24C 9/006 451/87 |
| 8,771,040 | B1 | 7/2014 | Lyras | |
| 9,022,835 | B1 | 5/2015 | Gus | |
| 9,085,065 | B2 | 7/2015 | Reilley | |
| 2003/0047495 | A1 | 3/2003 | Olejnik | |
| 2006/0040596 | A1 | 2/2006 | Robinson | |
| 2016/0325403 | A1 | 11/2016 | Lyras et al. | |
| 2020/0108486 | A1 * | 4/2020 | Griffin | B07B 1/46 |

* cited by examiner

300D

APPARATUS AND METHOD FOR SEPARATING REUSABLE ABRASIVE MEDIA FROM NON-REUSABLE MEDIA

RELATED APPLICATION(S)

Under provisions of 35 U.S.C. § 119(e), the Applicant(s) claim the benefit of U.S. provisional application No. 62/740,825, filed Oct. 3, 2018, which is incorporated herein by reference.

Related PCT Application No. PCT/US19/54593 filed on Oct. 3, 2019 in the name of Stan Griffin and Joe Craig, entitled "APPARATUS AND METHOD FOR SEPARATING REUSABLE ABRASIVE MEDIA FROM NON-REUSABLE MEDIA," assigned to the assignee of the present application, is hereby incorporated by reference.

It is intended that each of the referenced applications may be applicable to the concepts and embodiments disclosed herein, even if such concepts and embodiments are disclosed in the referenced applications with different limitations and configurations and described using different examples and terminology.

FIELD OF DISCLOSURE

The present disclosure relates to abrasive blasting devices. More specifically the present disclosure further is associated with at least the CPC classifications: B24C 1/00 Methods for use of abrasive blasting for producing particular effects; Use of auxiliary equipment in connections with such methods; B24C 3/00 Abrasive blasting machines or devices; B24C 7/00 Equipment for feeding abrasive material, Controlling the flowability, constitution, or other physical characteristics of abrasive blasts; B24C 11/00 Selection of abrasive materials (or additives) for abrasive blasts; B24C 5/00 Devices or accessories for generating abrasive blasts; B24C 9/00 Appurtenances of abrasive blasting machines or devices, e.g., working chambers, arrangements for handling used abrasive material.

BACKGROUND OF THE DISCLOSURE

Blast finishing with abrasive materials is a well-known industry. In many situations, blast machines have integrated separators that are supposed to separate reusable abrasive media from non-reusable media. In some cases, the reusable media is routed back into the blast machine or collection container and the non-reusable media is routed to a discards barrel. Conventionally, blast machine separators are not kept in peak operating condition. This often causes problems because literally tons of good, useable abrasive media travels with the non-reusable discards into waste barrels. Those barrels are then sealed and sent to the landfill. For example, wasting useable abrasive media can cost users tens of thousands of dollars or more. This is money that is literally thrown away and sent to a landfill.

Accordingly, there remains a need for improved methods for separating reusable abrasive media from non-reusable media. This need and other needs are satisfied by the various aspects of the present disclosure.

SUMMARY OF THE DISCLOSURE

In accordance with the purposes of the disclosure, as embodied and broadly described herein, the disclosure, in one aspect, relates to devices, systems, and methods for separating good, reusable blasting media from unwanted separator fines on blasting machines.

In further aspects, the present disclosure may generally relate to separating good blasting media from unwanted separator fines on blasting machines. Blast machines may have integrated separators that may be configured to separate reusable abrasive media from non-reusable media. The reusable media may be routed back into the blast machine or collection container and the non-reusable media may be routed to a discards barrel. Traditionally, blast machine separators may not be kept in peak operating condition causing literally tons of good abrasive to travel with the discards into waste barrels. Those barrels may then be sealed and subsequently may be sent to a landfill. The present disclosure may provide an apparatus which may be place in route to a discards barrel configured in a manner which may screen good abrasive from dust and fines particles. The apparatus may be portable and relatively inexpensive. Further, the apparatus may save users at least tens of thousands of dollars in wasted abrasive costs.

In further aspects, the present disclosure also relates to an apparatus, method, or system which may separate good abrasive blasting media from the unwanted dust and fines particles from sources outside of one or more blast machines. Blast machines may leak abrasive including but not limited to good abrasive, fines and dust particles. Leaked abrasive may be swept up from the floors, vacuumed from one or more catch pits and placed into barrels. The present disclosure may provide an apparatus which may be configured to screen the leaked dust and fines particles from leaked reusable abrasive.

In still further aspects, the present disclosure may classify abrasive medias in peening applications. Peening machines may require specific media sizes to accomplish particular peening criteria, standards, or policies. By draining a controlled portion of an abrasive media hopper through the apparatus provided in the present disclosure, the abrasive media may be separated into various sizes and subsequently into specific classifications. The present disclosure may further be configured in such a manner that peeners may be assured the media they are using meets the requirements.

Additional aspects of the disclosure will be set forth in part in the description which follows, and in part will be obvious from the description, or can be learned by practice of the disclosure. The advantages of the disclosure will be realized and attained by means of the elements and combinations particularly pointed out in the appended claims. It is to be understood that both the foregoing general description and the following detailed description are exemplary and explanatory only and are not restrictive of the disclosure, as claimed.

BRIEF DESCRIPTION OF THE DRAWINGS

The accompanying drawings, which are incorporated in and constitute a part of this specification, illustrate several aspects of the disclosure and together with the description, serve to explain the principles of the disclosure.

DETAILED DESCRIPTION OF THE DISCLOSURE

Figure 1A:
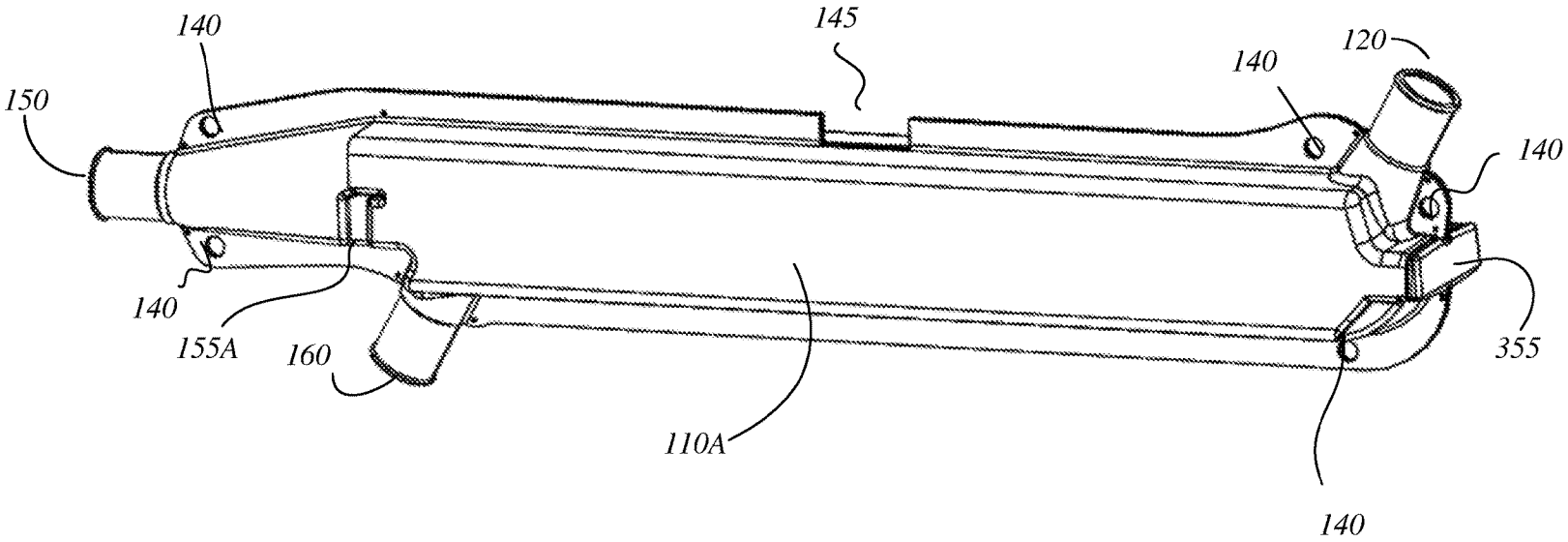
FIG. 1A shows a perspective view of an apparatus consistent with the present disclosure.

The present disclosure can be understood more readily by reference to the following detailed description of the disclosure and the Examples included therein.

Before the present articles, systems, devices, and/or methods are disclosed and described, it is to be understood that they are not limited to specific manufacturing methods unless otherwise specified, or to particular materials unless otherwise specified, as such can, of course, vary. It is also to be understood that the terminology used herein is for the purpose of describing particular aspects only and is not intended to be limiting. Although any methods and materials similar or equivalent to those described herein can be used in the practice or testing of the present disclosure, example methods and materials are now described.

All publications mentioned herein are incorporated herein by reference to disclose and describe the methods and/or materials in connection with which the publications are cited.

A. Definitions

It is also to be understood that the terminology used herein is for the purpose of describing particular aspects only and is not intended to be limiting. As used in the specification and in the claims, the term "comprising" can include the aspects "consisting of" and "consisting essentially of." Unless defined otherwise, all technical and scientific terms used herein have the same meaning as commonly understood by one of ordinary skill in the art to which this disclosure belongs. In this specification and in the claims which follow, reference will be made to a number of terms which shall be defined herein.

As used in the specification and the appended claims, the singular forms "a," "an" and "the" include plural referents unless the context clearly dictates otherwise. Thus, for example, reference to "an opening" can include two or more openings.

Ranges can be expressed herein as from one particular value, and/or to another particular value. When such a range is expressed, another aspect includes from the one particular value and/or to the other particular value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "about" and "at or about" mean that the amount or value in question can be the value designated some other value approximately or about the same. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

The terms "first," "second," "first part," "second part," and the like, where used herein, do not denote any order, quantity, or importance, and are used to distinguish one element from another, unless specifically stated otherwise.

As used herein, the terms "optional" or "optionally" means that the subsequently described event or circumstance can or cannot occur, and that the description includes instances where said event or circumstance occurs and instances where it does not. For example, the phrase "optionally affixed to the surface" means that it can or cannot be fixed to a surface.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

Disclosed are the components to be used to manufacture the disclosed devices, systems, and articles of the disclosure as well as the devices themselves to be used within the methods disclosed herein. These and other materials are disclosed herein, and it is understood that when combinations, subsets, interactions, groups, etc. of these materials are disclosed that while specific reference of each various individual and collective combinations and permutation of these materials cannot be explicitly disclosed, each is specifically contemplated and described herein. For example, if a particular material is disclosed and discussed and a number of modifications that can be made to the materials are discussed, specifically contemplated is each and every combination and permutation of the material and the modifications that are possible unless specifically indicated to the contrary. Thus, if a class of materials A, B, and C are disclosed as well as a class of materials D, E, and F and an example of a combination material, A-D is disclosed, then even if each is not individually recited each is individually and collectively contemplated meaning combinations, A-E, A-F, B-D, B-E, B-F, C-D, C-E, and C-F are considered disclosed. Likewise, any subset or combination of these is also disclosed. Thus, for example, the sub-group of A-E, B-F, and C-E would be considered disclosed. This concept applies to all aspects of this application including, but not limited to, steps in methods of making and using the articles and devices of the disclosure. Thus, if there are a variety of additional steps that can be performed it is understood that each of these additional steps can be performed with any specific aspect or combination of aspects of the methods of the disclosure.

It is understood that the devices and systems disclosed herein have certain functions. Disclosed herein are certain structural requirements for performing the disclosed functions, and it is understood that there are a variety of structures that can perform the same function that are related to the disclosed structures, and that these structures will typically achieve the same result.

Apparatus for Separating Reusable Abrasive Media from Non-Reusable Media

As briefly described above, the present disclosure relates, in various aspects, to an apparatus for separating reusable abrasive media from non-reusable media. In one aspect, the present disclosure provides an apparatus for separating reusable abrasive media from non-reusable media. In further aspects, the present disclosure relates to an apparatus comprising at least one of but not limited to: a mesh screen, at least one vibratory motor, at least one nozzle(s), at least one hose, at least one adapter, a flow monitor, at least one adapter configured to be used as a flow monitor for monitoring the flow. In still further aspects, the apparatus may further comprise a housing. In even further aspects, the apparatus may further comprise a housing configured to separate abrasive utilizing a system comprising the vibratory motor and the mesh screen placed along the line of the housing. In still further aspects, the present disclosure may provide an apparatus comprising a housing, a wire mesh screen, a vibratory motor, mounting hardware, one or more hoses, and one or more adapters. The apparatus may further comprise a flow monitor configured to display the cost savings. The apparatus may be fully functional without the flow monitor.

The present disclosure may provide an apparatus for separating reusable abrasive media from non-reusable media, the apparatus further comprising a housing configured to contain abrasive blasting media positioned in-line with the mesh screen.

The present disclosure may provide an apparatus for separating reusable abrasive media from non-reusable media via a mesh screen such that the apparatus may be configured to classify good, reusable abrasive blasting media and bad, unusable abrasive blasting media. The apparatus may further comprise a mesh screen wherein the mesh size may be determined based on abrasive media size used in an abrasive blasting machine.

The present disclosure may provide an apparatus for separating reusable abrasive media from non-reusable media further comprising a vibratory motor wherein the vibratory motor may be used to aid in the separation process. The vibratory motor may be configured to provide a means for creating a higher separation efficiency by vibrating the apparatus and one or more of the components of the apparatus.

The present disclosure may provide an apparatus for separating reusable abrasive media from non-reusable media further comprising hoses and/or adapters which may be configured to allow for mounting with existing structures, abrasive devices, abrasive machines, and abrasive media management systems and the likeness thereof.

The present disclosure may provide an apparatus for separating reusable abrasive media from non-reusable media further comprising a flow monitor which may be configured to allow one or more users or customers to monitor the flow of abrasive media through the apparatus. The flow monitor may be further configured to estimate, calculate, or analyze the particles sorted in real-time and provided to the one or more users or customers in a display or message. In other aspects, the flow monitor may be further configured to calculate or estimate at least one of but not limited to a future cost savings, a real-time cost savings, a budgetary analysis, a financial forecast that may project a realization of projected cost savings by measuring the flow of reusable abrasive through the apparatus for separating reusable abrasive media from non-reusable media device when discharging directly back into an abrasive media management system. The present disclosure may provide an apparatus for separating reusable abrasive media from non-reusable media that may be fully functional without a flow monitor. The flow monitor may not be required for operation of the apparatus.

Advantages and Innovations

The present disclosure may provide an apparatus for separating reusable abrasive media from non-reusable media further comprising a novel housing design which is specifically new to this type of product. The present disclosure may provide an apparatus further comprising components such as a screen mesh and vibratory motor which may have been used with one or more conventional media classifiers.

For instance, in the media classification currently done in the art may utilized a blast machine separator system that is often mounted way up high on the blast machine and needs constant monitoring to get any type of positive results. The size and construction of the systems allows for an out of sight, out of mind operation which causes tremendous waste of abrasive media. Moreover, blast machine operators must constantly be attentive to all components of any devices when it comes to controlling the separator. Momentary lapses can result in catastrophic losses of media. Existing systems may often consist of air wash and or magnetic separation to control the take-out size of abrasive media while striving to keep the good abrasive media in the system.

One of the prior art tools may be a peening apparatus. But the configurations make it more effective for general use for media classification from a primary storage hopper. Another prior art apparatus may be a secondary magnetic separator to further separate the sand fines from the good abrasive media.

While these existing devices may both comprise a mesh screen and a vibrating screen, the present disclosure provides an apparatus that offers an improved method for separating reusable abrasive media from non-reusable media that offers several advantages over existing solutions.

For example, the present disclosure provides an apparatus for separating reusable abrasive media from non-reusable media that may be at least a fraction of the cost of the prior art. Additionally, the present disclosure provides an apparatus for separating reusable abrasive media from non-reusable media that can be mounted in the air easily with mounting cables or other mounting options, in-line with the current separator fines discards hose. Furthermore, there is no existing platform or component that would work in the same manner with prior art. One or more separate structural platforms would have to be designed for the prior art to work in a similar manner.

However, the present disclosure may provide an apparatus that uses these components in a novel configuration and innovative apparatus that has not been used in the art. Moreover, the apparatus may further comprise specific novel features, including but not limited to, a rectangular screen separator mounted on the abrasive fines discards hose with the purpose of saving and sorting abrasive waste.

In still further aspects, the device can be useful for providing for more efficient and improved methods of abrasive media classification. In even further aspects, the present disclosure may provide one or more variations, embodiments, or alternative configurations for an apparatus for separating reusable abrasive media from non-reusable media.

The present disclosure may provide an apparatus for separating reusable abrasive media from non-reusable media further configured such that parts, steps, or components may be changed or equivalent parts substituted without changing the present disclosure.

Abrasive Media Classification

Throughout history, humans have used as abrasives everything from beach sand to walnut shells to paper bags. This section covers some of the most widely used types of manufactured abrasives. Manufactured abrasives, meaning primarily those materials that are created through a manufacturing process as opposed to being mined from the earth. Some naturally occurring materials are also produced artificially (such as aluminum oxide and naturally occurring diamond), so the distinction between these two categories is not absolute. Additionally, naturally occurring abrasives are often used in the same applications as manufactured abrasives. Thus, some naturally-occurring abrasives are herein incorporated as well.

Widely-used naturally occurring abrasives include garnet, cerium oxide, flint, emery, corundum (aluminum oxide), and diamond. These materials may have varying characteristics and chemical compositions depending on the specific geological source. Manufactured versions of these materials are usually more consistent in chemical composition and other characteristics.

Manufactured Abrasives:

Abrasives can be distinguished in a variety of ways—their hardness, color, chemical composition, crystal shape, and friability, to name but a few. Since the chemical composition—that is, the type of material—determines many of the other characteristics, we use that as the primary means of distinguishing one type of abrasive from another.

1. Chemical Composition

1a. Alumina Based (Aluminum Oxide, $Al_2O_3$) abrasive media having a hardness of 9.0 on Mohs hardness scale includes at least:

A. White Fused Aluminum Oxide which has high chemical purity (>99% $Al_2O_3$). It is generally used for applications where high purity is important including but not limited to medical, dental or other industrial uses. Additionally, this abrasive media may be generally softer or more friable than other abrasives. This abrasive media may be used in grinding applications where a more friable product is desired. This abrasive media may have granules that are typically are blocky shaped, with an aspect ratio of approximately 1:1 to 3:1.

B. White Calcined Aluminum Oxide—High purity aluminum oxide (>99.5% $Al_2O_3$), manufactured by growing individual crystals from seed crystals at high temperature. Crystals are hexagonal platelet shaped with an aspect ratio of 5:1. Used in a variety of lapping, buffing and polishing applications, incorporated into bars and pads, and used in ceramics.

C. Aluminum Oxide with Chrome—White Aluminum Oxide fused with $Cr_2O_3$ to enhance grinding; a pink abrasive used in grinding applications requiring slightly more toughness than White Fused Aluminum Oxide.

D. Brown Fused Aluminum Oxide—Abrasive with a content of 2-4% TiO2 to further enhance toughness; the "workhorse" of the industry; used in a wide variety of uses including Bonded, Coated, Refractory and Industrial markets; probably the most widely used abrasive.

E. Low Titania Brown Fused Aluminum Oxide—Abrasive with a content of 1-2% TiO2 to enhance toughness of the grain; generally used in Bonded or Coated applications requiring an abrasive slightly tougher than White Aluminum Oxide.

F. Zirconia-Alumina—The toughest of the alumina-based products; used in Bonded, Coated and Sandblasting applications requiring an extra tough abrasive.

G. Hydrated Alumina—Aluminum oxide with water chemically bonded to the alumina. Crystals are small (typically 1 mm or less in size) and very soft; typically used for fine polishing applications and as a raw material for ceramics.

H. Ceramic Aluminum Oxide—A high-purity fine-grained alumina obtained from sintering dispersed colloidal alumina. This provides a tough product primarily used for precision grinding of steels and hard alloys.

1b. Silicon Carbide (SiC) abrasive media having a hardness of 9.3 on Mohs hardness scale includes at least:

A. Silicon Carbide is a man-made abrasive material formed by a series of vapor-phase reactions of carbon and silicon dioxide at high temperature in an Acheson furnace. Alpha phase silicon carbide, in the form of hexagonally shaped platelets, is the most common form observed in the abrasives and refractories industries. The character of alpha silicon carbide is dependent on a number of factors such as purity of raw materials used in the Acheson furnace, and the reaction time and temperature.

B. Green Silicon Carbide is a man-made abrasive material having the highest purity Silicon Carbide that can be manufactured is generally used in grinding wheels for particular grinding properties or in industrial applications requiring a high purity coatings.

C. Black Silicon Carbide is a man-made abrasive material having lower purity (95-98%). Generally classified as a tougher Silicon Carbide generally used in Bonded, Coated, Refractory and Industrial markets for a wide variety of applications.

1c. Other Manufactured Abrasives Including Boron Carbide (B4C), Cubic Boron Nitride (CBN), and Diamond;

used for special applications requiring very hard materials for grinding and polishing. CBN and Diamond are also known as "Superabrasives."

2. Abrasive Shapes Particle shape affects the performance of the abrasive in a variety of ways, such as the rate of stock removal and level of subsurface damage. Some specialty applications require unusual shapes. For fused alumina and many other abrasives (such as silicon carbide), the aspect ratio (length to width) is a primary descriptor of shape. For others, the aspect ratio is irrelevant or misleading. Thus, fused aluminum oxide tends to have one long dimension and two smaller, roughly equal dimensions; i.e., the thickness is roughly equal to the width. Calcined alumina tends to have two long dimensions and one much smaller one; i.e. the length and width are roughly equal, but the thickness is about one-fifth the length. (For calcined alumina, this ratio, length to thickness, is often referred to as the aspect ratio). For more exotic shapes, aspect ratio may vary with the size of the particle and thus can only be given as a range.

2a. Blocky Shape abrasive having a high bulk density wherein the abrasive grain is "rounded" by abrading equipment to remove very sharp, weak grain. Depending on application, the grain shape can vary from "mulled" to blocky with sharp edges. The blocky shape may enhance toughness and bulk density of the grain. Applications include tougher grinding or sanding applications, longer life for sandblasting and increased density for refractory or ceramic applications. The aspect ratio of this abrasive is approximately 1:1.

2b. Blocky Shape abrasive having a medium bulk density wherein the abrasive grain is shaped to yield particles which are sharp but do not contain weak, platey or needlelike particles. Uses of this abrasive include but is not limited to general grinding, sanding, sandblasting and refractory applications. Aspect ratio is approximately up to 1.5:1.

2c. Sharp Shape abrasive having a low bulk density wherein the abrasive grain may have been specially crushed to yield very sharp grain. This is generally required by the coated abrasives industry and some grinding wheel applications to produce an aggressive, fast cutting product. Aspect ratio ranges from 1.5:1->3:1.

2d. Platelet Shaped abrasive which may generally found in calcined alumina.

2e. Extreme Shapes/Irregular Shapes abrasive having a variety of highly unusual shapes are possible through different manufacturing processes for specific applications. Includes extruded abrasives.

All abrasives contain particles with a range of sizes. In general, the more uniform in size the abrasive, the more expensive and difficult it is to manufacture. Sizing or grading refers to making the particle sizes within an abrasive more uniform so that the majority of the particles fall within a given range of sizes.

There are at least three ways this can be done: The abrasive particles themselves can be made smaller until they are all the same very small size; the abrasive particles can be joined together to make larger particles of a desired size; or the particles can be sorted into different sizes. Most abrasive manufacturing uses some combination of these methods to obtain particles of the desired size range.

Size Classification:

After size reduction, the material is separated into discrete size ranges. This is accomplished by a variety of means, including most prominently screening, air classifying, and water classifying. In screening, the material to be separated is passed over a series of screens with decreasing opening sizes. At the first, coarsest, screen, most of the material passes through, with only the largest particles retained on the screen and eventually collected. At the second screen, the next coarsest fraction is removed, and so on. In air classifying, the material is blown across a series of openings. The coarsest particles fall first; the finer particles fall later. Thus, size separation is achieved. There are two main forms of water classification, fractional sedimentation and elutriation. In fractional sedimentation, the material is mixed with water and a dispersing agent to allow for discrete settling. The agitation ceases, and the material begins to settle. After a given period of time, all particles over a given diameter will have settled at least to a given depth. The material and liquid above that depth are then removed, and the material removed from the liquid, while the remaining material is then remixed for further gradual material removal.

In elutriation, the same principle applies, but the column of water in which the material is settling is itself moving at a fixed rate (as more water is added near the bottom of the column). Particles small enough to settle more slowly than the column of water is moving upward are floated off and collected.

Characterization of Abrasives:

Abrasives are most commonly used to remove part of the surface of some material, called the substrate or workpiece. This removal is called abrading. The abrading occurs by rubbing the abrasive under some pressure against the surface to be abraded. To effectively abrade, the abrasive must be harder than the material being abraded. The rate at which the surface is removed, and the smoothness of the abraded surface, depend upon a variety of characteristics of the abrasive and the substrate. Of these, the most important is the size of the abrasive particles. When we speak of characterization of abrasives, we frequently mean describing the particle size distribution. If everything else is equal, larger particles abrade more rapidly, and leave a rougher surface, than smaller particles. Thus, it is important for the user to know approximately the size of the abrasive they are using. Abrasives with relatively large particles are called coarse; those with smaller particles are called fine. These are, of course, relative terms. It is more correct to call one abrasive coarser or finer than another.

The range of particle sizes may be described within an abrasive by means of a particle size distribution. Thus, it may be said that all of the particles are larger than ten microns in diameter, half of the particles are larger (and half smaller) than 30 microns in diameter, and none of the particles are larger than 60 microns in diameter. But the user of the abrasive may want to know if, having used this abrasive, they later use an abrasive in which all of the particles are larger than 11 microns, half are larger than 29 microns, and none are larger than 58 microns, they can expect it to perform the same.

Within the various types of abrasives discussed above, various sizes or grades of abrasive are available. These sizes are standardized within the abrasives industry. For example, while the particle size distribution of individual batches of ANSI 100 grade will vary, they will all meet a set of particle size distribution criteria. There will be few if any particles over 212 microns in diameter, no more than 20% of the abrasive will be made up of particles over 150 microns in diameter, etc.

Many individual abrasive manufacturers have also developed their own sets of size ranges; in general, the designations used have some connection to the size of the abrasive particles. The individual manufacturers can generally relate these sizes to those covered by one of the national or international standards. In addition to size, other characteristics of the abrasive, such as the bulk density, capillarity, pH, friability, surface area, and free iron and other chemical content may be crucial to appropriate performance in various applications. Development and updating standardized ways to measure such characteristics is the main focus of the Standards Committee. These standards provide the basis for manufacturers to supply globally.

Sizing Abrasive Media Particles:

Defining the size of a particle may be the mean diameter of the largest surface. Therefore, this particle would be the diameter of the larger circle shown. When size may be defined as the average diameter of all its sides, it would be considerably smaller. When size may be defined based on a particle's volume, it would be another value still. Sizing is based on the methods of measurement.

Methods of Measurement:

Abrasive sizes are broadly broken into two groups, macrogrits (also called "screen sizes") and microgrits (also called "sedimentation sizes"). This division is due to the different methods of size measurement traditionally used. (Some modern methods of particle size measurement may be used on either type of material, as discussed below.)

Screen Sizing Using Test Sieves:

For example, in order to make sure that none of the particles in our ANSI 100 grade abrasive were over 212 microns in diameter. Looking at a large volume under a microscope, checking to make sure there were no oversized particles; or, screening it through a sieve with openings 212 microns in size, hoping it all passed through. This latter method, using sieves with known opening sizes to see how much abrasive can pass through under given conditions, has long been the industry standard. These measurements are performed with specially produced and controlled test sieves.

Test sieves are woven wire or electroformed screens or perforated metal pans that are used for testing and sifting. Of these, woven wire sieves are most commonly used for testing materials to ensure they meet a designated particle size distribution. Woven wire test sieves are constructed by placing wire cloth between two suppressed die formed frames. Stainless steel or brass is generally used in the construction of both the frame and woven wire mesh that performs the sieving. These devices are widely used in various types of laboratory particle size analysis.

Test sieves are manufactured to standardized requirements; the specific standard used depends on where it is manufactured, and the type of sieve. In the United States, ASTM E11 covers the requirements for design and construction of woven wire cloth test sieves. European sieves are manufactured to ISO Standard 3310-1. Electroformed sieves are manufactured in the United States to ASTM E161, while perforated plate sieves are manufactured to ASTM E323, or British Standard BS140-1. All of these standards specify a number of properties to which any rated test sieves must adhere. These ratings include acceptable opening sizes, opening dimensions, maximum number of allowable openings in each test sieve, and in the case of woven wire sieves, nominal wire diameter.

Sieves are available in a number of quality levels, with the precise nomenclature used varying by manufacturer. Commonly used terms include certified, inspection, matched, calibrated, matched and calibrated, and midpoint. Certified or inspection sieves are the most widely used. They are manufactured to a national or international standard and come with a certificate of conformity. It is also possible to obtain pairs of sieves that have been manufactured and tested to match each other, and sieves with a test certificate which gives the range of tolerances and measurements taken.

MacroGrits (sizes 4 to 220 or 240, also called screen sizes or sieve sizes) are traditionally measured using test sieves. The particles in these sizes range from less than 45 microns to up to 8 mm (8000 microns). A range of particles is allowed to be present in a given size, with a maximum coarse limit and a minimum fine percentage. (For most sizes, no more than 3% of the abrasive by weight is allowed to be finer than the fine limit.) To determine the particle size distribution of a material, a stack of sieves with known openings is prepared, with the sieve with the biggest openings on top, the smallest on the bottom. A known weight of the material to be tested is placed on the top sieve, and the stack is shaken or tapped to sift the material through the sieves. (The devices most commonly used to tap or shake the sieves during testing are the Rotap™ and the CAMI™ sifter.) Particles too large to pass through a sieve are retained on top of it. After a given time, the stack is disassembled, and the material retained on each sieve is removed and weighed. If the top sieve on the stack has an opening of 200 microns, and all the material has passed through it, it may be determined that the material contains no particles larger than 200 microns. If the next sieve has an opening of 170 microns, and 10% of the material is retained on it, it may be determined that 10% of the material is from 170 to 200 microns in size. Thus, with the appropriate sieves, we can obtain a complete measurement of the distribution of particle sizes within it. Standard sizes have been developed both for the sieves and for the abrasives they measure. For the test sieves, these are given in the various standards mentioned above.

Microgrits (also called sedimentation sizes) are defined as sizes corresponding to 240 or 280 (approximately 60 microns in size) and finer. For many years, the standard method of measuring these sizes was through sedimentation using Stokes' Law. In lay terms, Stokes Law says that the bigger the particle, the faster it settles in a liquid. If you know the apparent specific gravity of the material, and the density and viscosity of the liquid, and the distance it settles, and the time it takes to settle, you can calculate how big the particle is. This is applied in practice through the use of a long column filled with alcohol (called the settling medium) at a known temperature, sitting inside a larger tube filled with water to maintain the alcohol at the correct temperature. At the bottom of the tube is a smaller graduated collecting tube. This apparatus is called a sedimentometer, or sedimentation tube. The material to be tested is pre-wet, then placed in the settling medium at the top of the tube, and the time recorded. When the first material reaches the collecting tube, the time is recorded. As the material reaches the various graduations in the settling tube, these times are recorded, until all the material has settled. Based on the total height of material in the tube, say 25 mm, it may be determined that the time required for the material to reach 12 mm represents 48% of the cumulative volume percentage. If it reached this height in 8 minutes, that means 48% of the material is 28.2 microns and coarser in size. If the 2 mm height was reached in 4 minutes, that means 8% of the material is 39.8 microns and coarser. (These figures are taken from material in ANSI Standard B74.10, for aluminum oxide. Times for materials with a different density, such as silicon carbide, are different.)

Microgrits: Electrical Resistance Method—Beginning in the 1970's, some abrasives companies began using electrical resistance to measure microgrits. The principle of electrical resistance measurement is that a particle will cause a change in the strength of a current proportional to the volume of the particle. The standard apparatus used for electrical resistance measurement is the Coulter Counter, which has gone through a variety of model numbers over the years.

National and International Size Standards

Macrogrits: Despite these problems, standards have been issued for full ranges of macrogrit and microgrit sizes by ANSI, FEPA, and JIS. (ANSI is of course the American National Standards Institute; FEPA is the European Federation of Abrasives Producers; and JIS is the Japanese Standardization Organization.) For macrogrits, these standards are all but identical, and differ only in a few of the sizes covered and the range of applications covered. ANSI standard B74.12-2001 gives two separate specifications, one for abrasives to be used for grinding wheel and general industrial applications, one for abrasives to be used for blasting. For the sizes covered, the only difference is material used for blasting need not be as tightly sized. Comparing ANSI B74.12-2001 with FEPA 43 GB-1984R1991 and JIS R6001-1987, the size requirements for sizes defined are identical. FEPA includes two sizes, F22 and F40, not covered by ANSI or JIS. JIS does not cover the four coarsest sizes, 4, 5, 6 and 7, covered by ANSI and FEPA.

ANSI B74.18-1996, currently under revision, covers coated abrasives. These sizing requirements are quite different from those for bonded and loose abrasives. (For brevity, the differing standards will be referred to as "bonded" and "coated.") In general, it is entirely possible that any particular abrasive that meets the requirements for a coated size will meet the requirements for the same bonded size (that is, an ANSI bonded 180 may also be acceptable as an ANSI coated 180), and vice-versa. It is also entirely possible that a FEPA F120 (bonded) will not meet the requirements of a FEPA P120 (coated), and vice-versa. This is because the standards specify different sieve sizes to be used for testing, allow or require different percentages of retained material on the various sieves, and in general state the requirements in a manner which frustrates direct comparison of the sizes.

Without entering into a detailed comparison of the standards, which the interested user is encouraged to do, one example will hopefully suffice. For FEPA P80 (coated), FEPA GB43-1991 requires all of the material to pass through a 355 micron sieve, and a maximum of 3% be retained on a 255 micron sieve. For FEPA F80 (bonded), FEPA 42 GB-1984R1993 requires all the material to pass through a 300 micron sieve. There is no requirement with regard to a 255 micron sieve, and up to 25% of the material may be retained on a 212 micron sieve. Clearly, a single abrasive with no particles over 255 microns would meet both these standards. But an abrasive with no particles over 355 microns, 1% from 300 to 355 microns, and 2% from 255 to 300 microns would meet the coated standard and fail the bonded one. An abrasive with no particles over 300 microns but 4% from 255 to 300 microns would meet the bonded standard and fail the coated one.

With regard to ANSI B74.18-1996, direct comparison is even more difficult, since the standard in general does not specify what percentages may or must be retained. Instead, the sieves themselves are first calibrated with a standard sand (see Appendix 3). The requirements for the material to be tested are then expressed in terms of the performance of the sieve with regards to the standard sand. Thus, for a coated ANSI 120, the maximum percentage allowed to be retained on a 133 micron sieve is 1.2 times the percentage of standard sand retained on that same sieve. The 133 micron sieve must have retained from 9.9 to 17.9 percent of the 120 standard sand. That same sieve is then used as a fines control sieve for coated 100 grade. The percentage of material which passes through that sieve must be within +10%/−7% of the percentage of the 100 grade standard sand which passed through it.

In comparing coated with bonded macrogrits, the most that can be said is that the sizes are approximately the same, but the specified requirements differ sufficiently to require individual appraisal of batches of material.

Thus, for ANSI grade 80 (FEPA F80, JIS 80), a total of 65% of the sample must be retained on sieves with openings of 150 and 180 microns. At least 75% of the size must pass through a sieve with an opening of 212 microns. The range shown for size 80 is thus 150 to 212 microns: at least 65% of the sample, including the median size, will fall within this range.

MICROGRITS: Comparison of standards for microgrits is not as straightforward. ANSI standards for coated and bonded grains differ substantially, as do the FEPA standards for coated (called "FEPA P") and bonded (called "FEPA F") grains. The JIS standard is also quite different. For the most part, the standards specify a) a minimum value which 94% of the abrasive must be coarser than, b) a maximum value that 97% of the abrasive must be finer than, and c) the range in which the midpoint must fall.

Superabrasives

As noted above, some manufactured abrasives, commonly diamond and cubic boron nitride (CBN), are characterized as superabrasives due largely to their extreme hardness. These are used in a variety of demanding high-tech applications. Standard sizes of these materials and approved testing methods are defined in ANSI B74.20-2004, currently under pre-publication formatting as of this writing. In general, standard sizes for these materials are defined as a size range (e.g. 1-2 microns, 6-12 microns). The standard specifies that materials in these sizes must include at least 90% of the particle size distribution within the size ranges specified (maximum of 5% each above and below the range). For example, for a 1-2 micron size, at least 95% of the sample must be above 1 micron in size, and no more than 5% of the sample may be over 2 microns in size. The sample's average size must be near the center of the desired distribution (1.28-1.72 microns for a 1-2 micron material). Additionally, the coarsest particle detected must be below a maximum limit (e.g. 6 microns for size 1-2, 20 microns for size 6-12). ANSI B74.20 also describes a variety of methods that are commonly used to characterize the particle size, including a number discussed above (such as electrical resistance, direct microscopy, laser diffraction, and photosedimentation) and a few methods unique to characterizing extremely fine particles (such as photon correlation spectroscopy).

Abrasive Media Classification with the Present Disclosure

For example, the present disclosure may provide an apparatus for separating reusable abrasive media from non-reusable media further comprising a housing which may be configured to be composed of plastic thermoformed housing cast out of metal or fabricated out of structural shapes, a plate, or even metal stamped with slight modifications to the one or more housing designs. In one or more embodiments, the housing may be composed of steel, abrasive resistant steel, one or more metals, metallics, alloys, or other materials. The one or more housing designs may vary in size to fit within one or more abrasive media management systems of various sizes. Furthermore, the apparatus further comprising the housing may be adapted to fit various screen mesh sizes such that one or more could be inserted into the apparatus for separating reusable abrasive media from non-reusable media based on the size of the media being classified. The present disclosure may provide an apparatus for separating reusable abrasive media from non-reusable media further configured to support the use of interchangeable screens.

The present disclosure may be used in the metal processing industry dealing with abrasive media. In one or more embodiments, the present disclosure may be constructed using at least one of plastic, heavy duty plastic. In one or more embodiments, the housing may be produced using a thermo molding process.

The present disclosure provides for uses with other types of abrasive media including but not limited to sand, glass, and other abrasives. The present disclosure may be adapted for use with foundries. In one or more such embodiments, the apparatus may be constructed from steel, abrasive resistant steel, one or more metals, metallics, alloys, or other materials.

The apparatus may further comprise a slidably removable screen, vibratory screen or mesh screen. The slidably removable screen allows for more efficient replacement of screens during use. The desired screen size may be changed based on the size and type of the abrasive media being processed. The apparatus may be configured with the slidably removable screen or slidably removable separator assembly to allow for interchangeable replacement of the screen based on the desired size of the abrasive media to be classified or sorted. In one or more embodiments, separator assembly may comprise one or more mesh screens or mesh screen assemblies. In one or more embodiments, the one or more mesh screens may be configured to be stacked, vertically aligned, horizontally aligned, geometrically aligned, and integrated to provide a desired level of media classification.

The apparatus may further comprise one or more magnets configured to catch abrasive media during the initial discards processing. In one or more embodiments, the magnets may be shaped in one or more shapes including but not limited to: a rectangular shape, a square shape, a circular shape, an ellipse, and a geometric shape. In one or more embodiments, the one or more magnets may be placed on a backstop of the inner housing to capture the abrasive media during the initial discards processing when receiving abrasive media from the discards inlet.

The apparatus may further comprise a rubber mounting grommet. The mounting grommet may be constructed from one or more other materials including but not limited to felt, rubber, silicone, foam, metal, plastic, or other suitable mounting components. Furthermore, the present disclosure may provide an apparatus for separating reusable abrasive media from non-reusable media further comprising one or more different variations of mounting bracket designs.

The present disclosure may provide an apparatus for separating reusable abrasive media from non-reusable media that may be further configured for highly effective separation of media as it relates to abrasive blasting or peening. The apparatus may be further configured or adapted for separation of any media or aggregate of various sizes.

The present disclosure may provide an apparatus for separating reusable abrasive media from non-reusable media further comprising one or more screens. The apparatus may be configured to provide notification or indicators to a user when the one or more screens need to be replaced. Maintenance notification of the present disclosure may provide for more effective use of the apparatus even after several thousand hours of operation. The present disclosure provides an innovative feature of maintenance notification to a user by at least a flow monitor. The present disclosure provides added advantages over prior art systems which lack such features. Prior art systems consistently fail due to poor maintenance resulting in reusable abrasive media being discarded with the abrasive media fines.

The present disclosure may provide an apparatus for separating reusable abrasive media from non-reusable media further comprising a housing. The apparatus may be configured to provide notification or indicators to a user when the housing needs to be replaced. The apparatus may not be configured to work effectively with worn out housing or after several thousand hours of operation. Failure to properly maintain the apparatus by not replacing the housing may result in the good abrasive media being discarded with the abrasive media fines. As such, the apparatus may not work as the right of the apparatus for separating reusable abrasive media from non-reusable media housing may wear through from the abrasive fines sliding through to the discharge. Magnetic sheets may be installed to combat such wear, creating an abrasive on abrasive slide.

The present disclosure may provide an apparatus for separating reusable abrasive media from non-reusable media further comprising a housing. Wherein the housing may be made of an abrasive resistant plastic such as ultra-high molecular weight (UHMW), ABS, or polypropylene. Furthermore, the housing may be constructed from but not limited to casting out of abrasive resistant steel, tool steel, high chrome alloy, or suitable material meeting the required conditions for use with abrasive media.

Other components of the apparatus such as the mesh screen may be constructed from but not limited to Stainless Steel, Oil Tempered Steel, or suitable material meeting the required conditions for use with abrasive media.

In another aspect, the present disclosure provides an apparatus for abrasive media classification.

In another aspect, the present disclosure may be adapted to receive discards from an abrasive media classifier. The present disclosure provides for refinement of the received discards resulting in separation of the non-reusable abrasive media from the reusable abrasive media. The use of magnets in the present disclosure allows for the effective protection of the apparatus. Moreover, magnets placed within the apparatus at one or more positions within at least one of the mesh screen, mesh screen frame, interior housing surface, exterior housing surface, or other component of the apparatus provide wear protection against constant contact with the abrasive media. Specifically, one or more magnets placed at the one or more points of contact of the abrasive media allows the initial abrasive to adhere to the point of contact providing a layer of abrasive insulating the material surface of the point of contact and the abrasive media. In one or more embodiments, at least one magnet may be placed at the initial point of contact where the abrasive media discards are received by the abrasive media inlet. In one or more embodiments, at least one magnet may be used to provide layers of wear protection at one or more points of contact for the abrasive media passing through the apparatus.

In one or more aspects, the present disclosure may be established at an angled position to enhance efficiency of performance. In one or more embodiments, the apparatus may be set at an angle less than ninety degrees. In one or more embodiments, the angle for enhanced performance may be at least one of: thirty degrees, fifteen degrees, forty-five degrees, and any angle less than ninety degrees. In at least one embodiment, the most efficient angle position for the apparatus is thirty degrees.

In another aspect, the present disclosure provides a system of components operating together to provide effective abrasive media classification and separation. In another aspect, the present disclosure provides a means for separating reusable abrasive media from non-reusable media.

In one or more embodiments, the use of the present disclosure may be in conjunction with at least one of: an electronic flow monitor, a monitoring device, a temperature monitor, and tracking device; each configured for use with computer or computing device having a user interface and module. The computing device having a user interface and module capable of monitoring characteristics of the abrasive media processing of the apparatus and system. In one or more embodiments, the computing device may monitor the flow rate, the condition of the screen, the condition of the housing, any blockages, degradation of any hardware, and other characteristics. In one or more embodiments, the present disclosure may be adapted for use with a software application which manages the tracking information, presents the user interface to the user, and provide alerts or notification for issues with the apparatus or system. In one or more embodiments, the flow monitor may further comprise an optical sensor.

FIG. 1A shows a diagram of an apparatus consistent with the present disclosure. More specifically, FIG. 1A, 100A shows a perspective view of the apparatus for separating reusable abrasive media from non-reusable media. FIG. 1A, 110A shows the right exterior surface of the housing assembly. FIG. 1A, 120 shows the separator discards inlet port. The separator discards inlet port 120 may be in one or more embodiments, discards from an abrasive classifier device may be received in the separator discards inlet port 120. In one or more embodiments, the separator discards inlet port 120 may be attached by an attachment of at least one of: an adapter, a hose, a clamp, a seal, a fastener, and other connector. FIG. 1A, shows housing aperture 130 accepting the mesh screen frame 310 with the posterior mesh screen terminus 355 fitting inside of housing aperture 130 and terminating outside the posterior plane of the apparatus 350 (shown in FIGS. 3A, 3B, and 3C at 350). FIG. 1A, 140 shows one or more connection points or apertures in housing 110. In one or more embodiments, the one or more connection points 140 may be configured to accept at least one rubber grommet 141. The at least one rubber grommet 141 configured to be connected to at least one fastener 143 wherein the at least one fastener 143 comprises at least one of: a hose clamp, a screw, a clasp, a binding, an adhesive, a C-clamp, a bolt, a heavy-duty bolt, a screw anchor, and fastener. FIG. 1A, 145 shows a mounting post for the vibratory motor 170 (Shown in FIG. 1B, 100B at 170). The mounting post 145 may further comprise a mounting pad wherein the mounting pad may comprise rubber, plastic, steel, metal, composite, or other material consistent with ASME standards. FIG. 1A, 150 shows the reusable abrasive media outlet port. In one or more embodiments, the reusable abrasive media outlet port 150 may be attached by an attachment of at least one of: an adapter, a hose, a clamp, a seal, a fastener, and other connector. FIG. 1A, 155 shows a right exterior rectangular shaped bump stop indentation configured to accept the anterior mesh screen frame terminus point on the right exterior surface 110A of the housing assembly 110. A complementary left exterior rectangular shaped bump stop indentation configured to accept the anterior mesh screen frame terminus point on the left exterior surface 110B of the housing assembly 110. FIG. 1A, 160 shows the separator fines discards outlet port for non-reusable abrasive media.

Figure 1B:
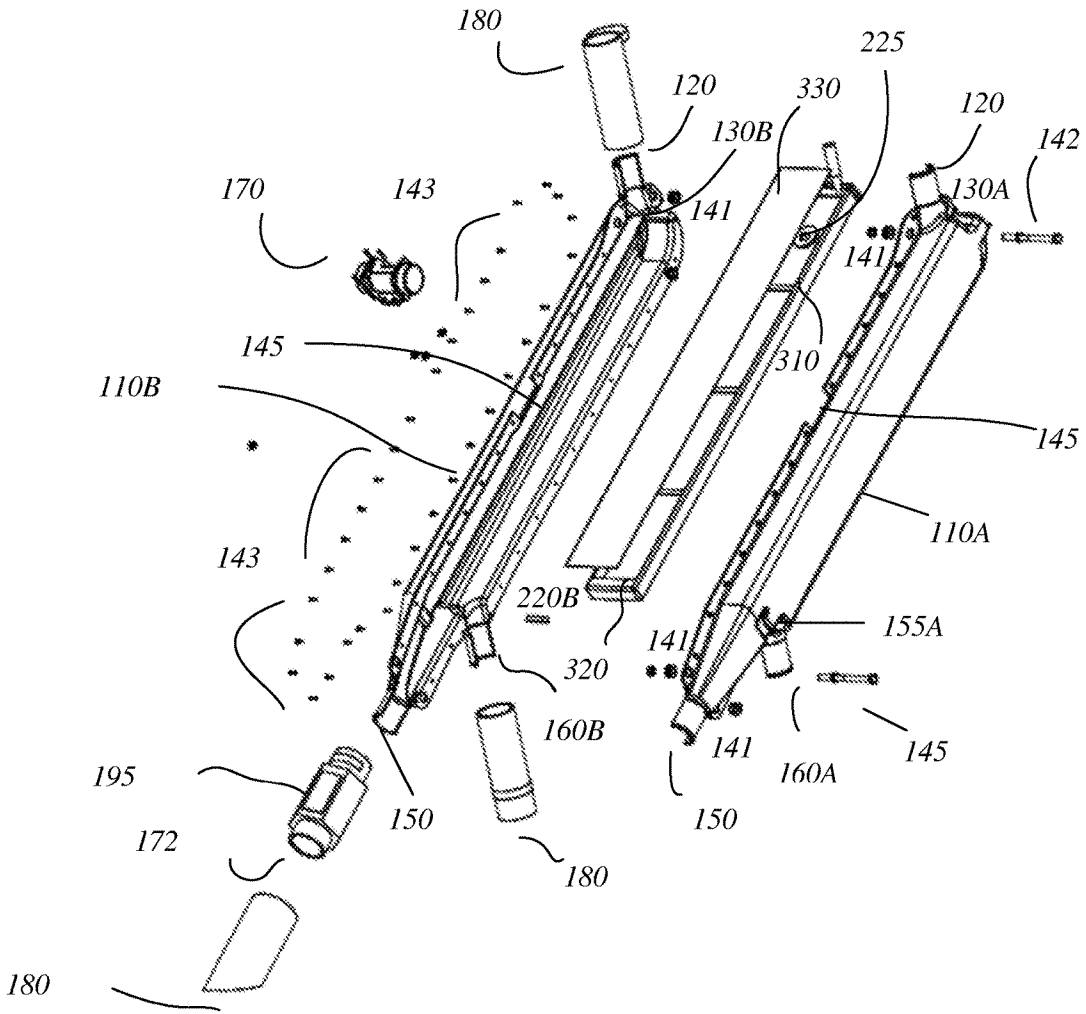
FIG. 1B shows an exploded view of an apparatus consistent with the present disclosure.

FIG. 1B, 100B shows an exploded view of an apparatus consistent with the present disclosure. More specifically, FIG. 1B, 100B depicts an exploded view of the apparatus for separating reusable abrasive media from non-reusable media. Furthermore FIG. 1B, 100B depicts the assembly of the apparatus parts and components of various quantities. In another aspect, FIG. 1B, 100B shows the assembly of the apparatus for separating reusable abrasive media from non-reusable media. FIG. 1B, 110A shows the right exterior surface of the housing assembly. FIG. 1B, 110B shows the left exterior surface of the housing assembly. FIG. 1B, 120 shows the separator discards inlet port. The separator discards inlet port 120 may be in one or more embodiments, discards from an abrasive classifier device may be received in the separator discards inlet port 120. In one or more embodiments, the separator discards inlet port 120 may further comprise a flow controller or flow monitor to regulate the flow of media. In one or more embodiments, the separator discards inlet port 120 may be attached by an attachment of at least one of: an adapter, a hose 180, a clamp, a seal, a fastener, and other connector. FIGS. 1B, 130A and 130B shows a right section and left section of housing aperture 130 configured to accept mesh screen frame 310 formed by the junction between the left housing assembly 110B and the right housing assembly 110A. FIG. 1B, 140 shows one or more connection points or apertures in housing 110. In one or more embodiments, the one or more connection points 140 may be configured to accept at least one rubber grommet 141. The at least one rubber grommet 141 configured to be connected to at least one fastener 143 wherein the at least one fastener 143 comprises at least one of: a hose clamp, a screw, a clasp, a binding, an adhesive, a C-clamp, a bolt, a heavy-duty bolt, a screw anchor, and fastener. In one or more embodiments, 143 may further comprise at least one of: a screw, a fastener, and a stainless-steel screw and rubber grommet combination configured to fasten both sides of housing 110 together and hold the apparatus in place. In one or more embodiments, lubricants, adhesives, chemicals, and additives may also be used to help keep both sides of the housing together. FIG. 1B, 142 shows a mounting bolt configured to mount the apparatus when desired by a user. In one or more embodiments, 142 may further comprise at least one of: a bolt, a heavy-duty bolt, a screw anchor, and fastener. FIG. 1B, 145 shows a mounting post for the vibratory motor 170 (Shown in FIG. 1B, 100B at 170). The mounting post 145 may further comprise a mounting pad wherein the mounting pad may comprise rubber, plastic, steel, metal, composite, or other material consistent with ASME standards. FIG. 1B, 150 shows the reusable abrasive media outlet port. In one or more embodiments, the reusable abrasive media outlet port 150 may further comprise a flow controller 195 to regulate the flow of media. In one or more embodiments, the reusable abrasive media outlet port 150 may be attached by an attachment of at least one of: a hose 180, a clamp, a seal, a fastener, and other connector. FIG. 1B, 155A shows a right exterior rectangular shaped bump stop indentation configured to accept the anterior mesh screen frame terminus point on the right exterior surface 110A of the housing assembly 110. A complementary left exterior rectangular shaped bump stop indentation 155B is configured to accept the anterior mesh screen frame terminus point on the left exterior surface 110B of the housing assembly 110. FIG. 1B, 160A shows the right sectional view of the separator fines discards outlet port for non-reusable abrasive media. FIG. 1B, 160B shows the left sectional view of the separator fines discards outlet port for non-reusable abrasive media. In one or more embodiments, the separator fines discards outlet port 160 may further comprise a flow controller to regulate the flow of media. In one or more embodiments, the separator fines discards outlet port 160 may be attached by an attachment of at least one of: a hose 180, a clamp, a seal, a fastener, and other connector. FIG. 1B, 172 shows a flow monitor aperture for the flow monitor 195. In one or more embodiments, the flow monitor 195 may be used for one or more portals 120, 150, or 160. FIG. 1B, 310 shows a mesh screen frame used to house a mesh screen. FIG. 1B, 320 shows a mesh screen configured to classify abrasive media based on the size of the mesh screen and size and type of abrasive media. FIG. 1B, 330 shows the top surface of the separator assembly comprising at least one of: a vibratory screen, mesh screen, mesh screen frame, at least one motor, at least one magnet, a slidably removable vibratory screen, a media shield, a posterior mesh screen terminus configured to fit inside of housing aperture 130 and terminate outside the posterior plane of the apparatus 350, and other classifying components.

FIG. 1B, 100B shows a separator assembly comprising: the left housing assembly 110B, the right housing assembly 110A, the mesh screen 320, the mesh screen frame 310, the top surface of a separator assembly, and internal components. When assembled, the separator assembly further comprises at least one wire mesh screen, at least one vibratory motor, and one or more mounting hardware components. The separator assembly may be further configured to separate a main channel into a first channel for reusable abrasive media and a second channel for non-reusable abrasive media separated by the at least one wire mesh screen. The separator assembly may be further configured to separate reusable abrasive media from non-reusable abrasive media by passing the separated reusable abrasive media via the first channel and by passing the separated non-reusable abrasive media via the second channel. The separator assembly may be further configured wherein the first channel may terminate at a reusable abrasive media outlet valve 150 further comprising at least one first hose, at least one first adapter and wherein the second channel may terminate at a discards abrasive media outlet valve 160. FIG. 1B, 225 shows a mesh screen magnet attached to the mesh screen 320 to provide wear protection for the mesh screen initial point of contact with the abrasive media. The magnet 225 causes abrasive to adhere to the mesh screen initial point of contact creating an insulating layer of abrasive. As described above, abrasive will not degrade itself. This magnet 225 may provide varying types of wear protection based on the size and power of the magnet. The magnet 225 may be of varying sizes and power of magnetic attraction. FIG. 1B, 220B shows a magnet attached to the left housing interior surface 210B to provide wear protection for the left housing interior surface point(s) of contact with the abrasive media. The magnet 220B causes abrasive to adhere to point(s) of contact creating an insulating layer of abrasive. As described above, abrasive will not degrade itself. This magnet 220B may provide varying types of wear protection based on the size and power of the magnet. The magnet 220B may be of varying sizes and power of magnetic attraction. A complementary magnet 220A attached to the right interior surface 210A of the housing assembly 110 configured to provide wear protection for the right housing interior surface point(s) of contact with the abrasive media. Magnets may be placed at other places throughout the housing 110.

Figure 1C:
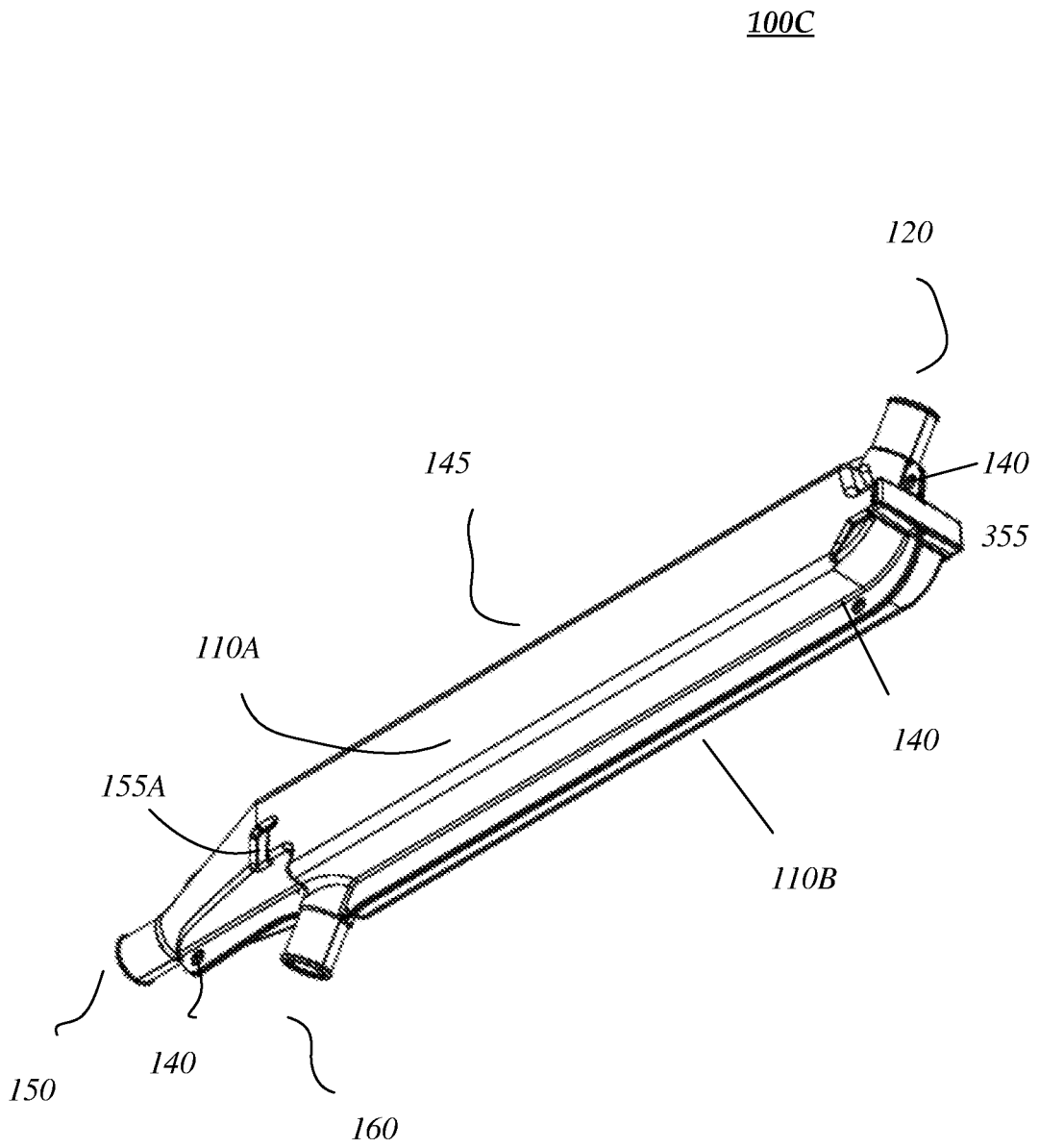
FIG. 1C shows another perspective view of an apparatus consistent with the present disclosure.

FIG. 1C shows another perspective view of an apparatus consistent with the present disclosure. More specifically, FIG. 1C, 100C depicts another perspective view of the apparatus for separating reusable abrasive media from non-reusable media. Furthermore FIG. 1C, 100C depicts the assembly of the apparatus parts and components of various quantities. In another aspect, FIG. 1C, 100C shows the assembled apparatus for separating reusable abrasive media from non-reusable media. FIG. 1C, 110A shows the right exterior surface of the housing assembly. FIG. 1C, 110B shows the left exterior surface of the housing assembly. FIG. 1C, 120 shows the separator discards inlet port. The separator discards inlet port 120 may be In one or more embodiments, discards from an abrasive classifier device may be received in the separator discards inlet port 120. In one or more embodiments, the separator discards inlet port 120 may further comprise a flow controller or flow monitor to regulate the flow of media. In one or more embodiments, the separator discards inlet port 120 may be attached by an attachment of at least one of: an adapter, a hose, a clamp, a seal, a fastener, and other connector. FIG. 1C, 130 shows a housing aperture accepting the mesh screen frame 310 with the posterior mesh screen terminus 355 fitting inside of housing aperture 130 and terminating outside the posterior plane of the apparatus 350 (shown in FIGS. 3A, 3B, and 3C at 350). FIG. 1C, 140 shows one or more connection points or apertures in housing 110. In one or more embodiments, the one or more connection points 140 may be configured to accept at least one rubber grommet 141. The at least one rubber grommet 141 configured to be connected to at least one fastener 143 wherein the at least one fastener 143 comprises at least one of: a hose clamp, a screw, a clasp, a binding, an adhesive, a C-clamp, a bolt, a heavy-duty bolt, a screw anchor, and fastener (141 and 143 shown in FIG. 1B). FIG. 1C, 145 shows a mounting post for the vibratory motor 170 (Shown in FIG. 1B, 100B at 170). The mounting post 145 may further comprise a mounting pad wherein the mounting pad may comprise rubber, plastic, steel, metal, composite, or other material consistent with ASME standards. FIG. 1C, 150 shows the reusable abrasive media outlet port. In one or more embodiments, the reusable abrasive media outlet port 150 may further comprise a flow controller 195 to regulate the flow of media. In one or more embodiments, the reusable abrasive media outlet port 150 may be attached by an attachment of at least one of: a hose 180, a clamp, a seal, a fastener, and other connector. FIG. 1C, 155A shows a right exterior rectangular shaped bump stop indentation configured to accept the anterior mesh screen frame terminus point on the right exterior surface 110A of the housing assembly 110. A complementary left exterior rectangular shaped bump stop indentation 155B is configured to accept the anterior mesh screen frame terminus point on the left exterior surface 110B of the housing assembly 110. FIG. 1C, 160 shows the separator fines discards outlet port for non-reusable abrasive media.

In accordance with FIGS. 1A, 1B, and 1C, the left housing assembly 110B and right housing assembly 110A are symmetrically bisected. The left housing is depicted having a left sectional portion of the separator discards inlet port 120, the left sectional portion of the reusable abrasive media outlet port 150, and the left sectional portion of the separator fines discards outlet port 160. The right housing is depicted having a right sectional portion of the separator discards inlet port 120, the right sectional portion of the reusable abrasive media outlet port 150, and the right sectional portion of the separator fines discards outlet port 160.

The reusable abrasive media outlet port 150 may be configured to send good abrasive media back to a machine or drum. In one or more embodiments, lubrication may be provided for the separator assembly at the center of housing 110 by applying at least one of: a bead of caulking, an amount of oil, an amount of viscous material, an amount of ointment, and a lubricant. The lubrication may be placed on the center rib, alongside the mesh frame 310, at the dorsal end of the posterior mesh screen terminus 355 configured to fit inside of housing aperture 130 and terminate outside the posterior plane of the apparatus 350, grooves, edges, and outer edges of the screen holder component of the housing 110 and separator assembly. The separator assembly further comprising at least one of: a vibratory motor 170, a mesh screen 320, one or more mesh screens of various opening sizes, a hanging mount rubber grommet, a flow monitor 195, a flow controller, and a controller. The apparatus further comprising at least one of: a lock washer, one or more connectors, a serial number name plate, a vibratory motor, a mesh screen, one or more mesh screens of various opening sizes, a hanging mount rubber grommet, a flow monitor, a flow controller, a controller, a hose 180, a clamp, a seal, at least one fastener, and other connector, wherein the at least one fastener comprises at least one of: a hose clamp, a screw, a clasp, a binding, an adhesive, a C-clamp, a bolt, a heavy-duty bolt, a screw anchor, and fastener.

The apparatus may further comprise application of at least one of: an adhesive to mesh screen frame 310 outer edges to secure mesh screens 320 to mesh screen frame 310, a magnetic rubber wear pad secured with adhesive to interior posterior mesh screen terminus configured to fit inside of housing aperture 130 and terminate outside the posterior plane of the apparatus 350 thes within the separator assembly to extend life expectancy of the apparatus, a removable mesh screen frame 310 configured for removal for inspection and/or replacement. The apparatus may further comprise hoses 180 and adapters 170 of various sizes configured for various sizes and types of media. In one or more embodiments, the apparatus may further comprise the use of hoses and adapters ranging from less than one inch to three inches or greater. The apparatus may further comprise one or more metering valves. The apparatus may further be configured for use with safety whips on hoses 180 and housing assembly 110 where needed.

Figure 2:
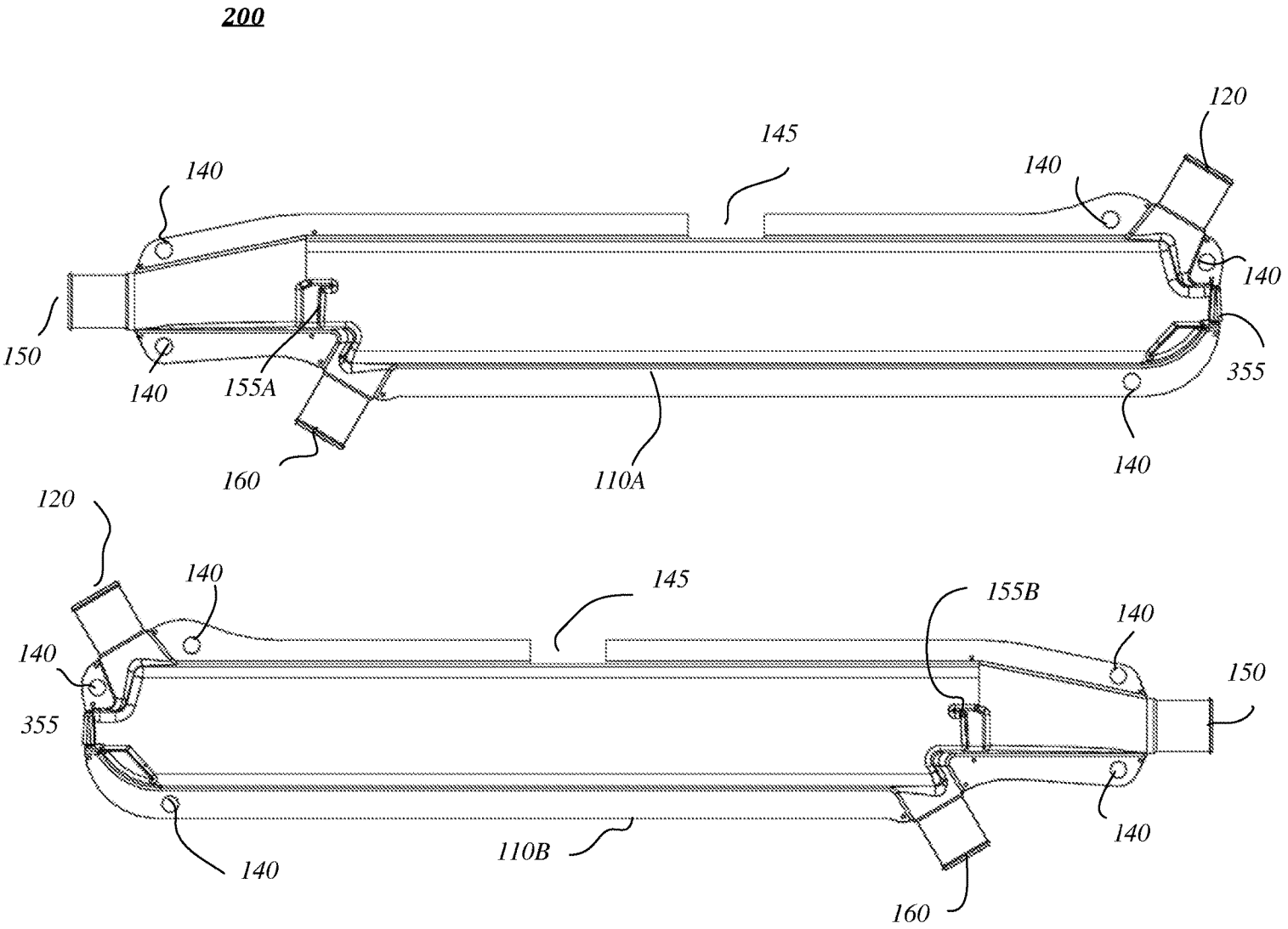
FIG. 2 shows a left-side view and right-side view of an apparatus consistent with the present disclosure.

FIG. 2, 200 shows a diagram of an apparatus consistent with the present disclosure. More specifically, FIG. 2 depicts a side view of the apparatus for separating reusable abrasive media from non-reusable media. In another aspect, FIG. 2 shows parts and an assembly of the apparatus for separating reusable abrasive media from non-reusable media. FIG. 2, 200 depicts the assembly of parts of various quantities. FIG. 2, 200 also depicts the connections and fittings to other components on the blasting machine or abrasive media classification system. In FIG. 2, the front of the housing is depicted having a separator fines discards outlet 150 and connector to send good abrasive media back to the blast machine or drum. The top of the housing 110 is depicted having a separator fines discards inlet 120.

Furthermore, FIG. 2, 200 shows a left-side view and right-side view of the apparatus for separating reusable abrasive media from non-reusable media. Furthermore FIG. 2, 200 depicts the assembly of the apparatus parts and components of various quantities. In another aspect, FIG. 2, 200 shows the assembly of the apparatus for separating reusable abrasive media from non-reusable media. FIG. 2, 110A shows the right exterior surface of the housing assembly. FIG. 2, 110B shows the left exterior surface of the housing assembly. FIG. 2, 120 shows the separator discards inlet port. The separator discards inlet port 120 may be In one or more embodiments, discards from an abrasive classifier device may be received in the separator discards inlet port 120. In one or more embodiments, the separator discards inlet port 120 may further comprise a flow controller or flow monitor to regulate the flow of media. In one or more embodiments, the separator discards inlet port 120 may be attached by an attachment of at least one of: an adapter, a hose, a clamp, a seal, a fastener, and other connector. FIG. 2, 130 shows a housing aperture accepting the mesh screen frame 310 with the posterior mesh screen terminus 355 fitting inside of housing aperture 130 and terminating outside the posterior plane of the apparatus 350 (shown in FIGS. 3A, 3B, and 3C at 350). FIG. 2, 140 shows one or more connection points or apertures in housing 110. In one or more embodiments, the one or more connection points 140 may be configured to accept at least one rubber grommet 141. The at least one rubber grommet 141 configured to be connected to at least one fastener 143 wherein the at least one fastener 143 comprises at least one of: a hose clamp, a screw, a clasp, a binding, an adhesive, a C-clamp, a bolt, a heavy-duty bolt, a screw anchor, and fastener. FIG. 2, 145 shows a mounting post for the vibratory motor 170 (Shown in FIG. 1B, 100B at 170). The mounting post 145 may further comprise a mounting pad wherein the mounting pad may comprise rubber, plastic, steel, metal, composite, or other material consistent with ASME standards. FIG. 2, 150 shows the reusable abrasive media outlet port. In one or more embodiments, the reusable abrasive media outlet port 150 may further comprise a flow controller 195 to regulate the flow of media. In one or more embodiments, the reusable abrasive media outlet port 150 may be attached by an attachment of at least one of: a hose 180, a clamp, a seal, a fastener, and other connector. FIG. 2, 155A shows a right exterior rectangular shaped bump stop indentation configured to accept the anterior mesh screen frame terminus point on the right exterior surface 110A of the housing assembly 110. A complementary left exterior rectangular shaped bump stop indentation 155B is configured to accept the anterior mesh screen frame terminus point on the left exterior surface 110B of the housing assembly 110. FIG. 2, 160 shows the separator fines discards outlet port for non-reusable abrasive media.

Figure 3A:
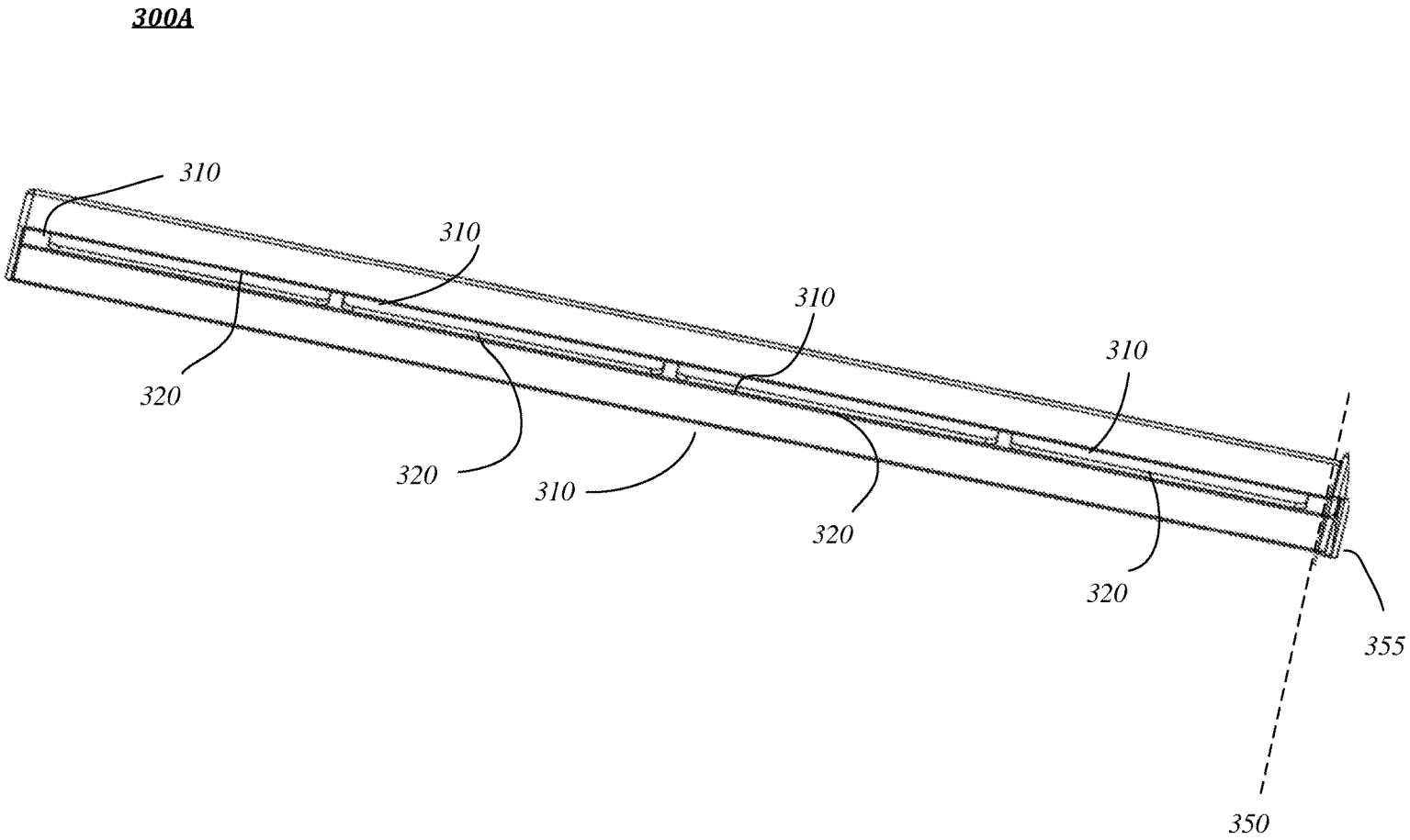
FIG. 3A shows a perspective view of the separator assembly of an apparatus consistent with the present disclosure.

FIG. 3A shows a perspective view of the separator assembly the apparatus for separating reusable abrasive media from non-reusable media. Furthermore FIG. 3A, 300A depicts the assembly of the apparatus parts and components of various quantities. In another aspect, FIG. 3A, 300A shows the assembly of the apparatus for separating reusable abrasive media from non-reusable media. FIG. 3A, 300A shows a slidably removable mesh screen assembly comprising a mesh screen frame 310 used to house a mesh screen 320 configured to classify abrasive media based on the size of the mesh screen and size and type of abrasive media; and a posterior mesh screen terminus 355 configured to fit inside of housing aperture 130 and terminate outside the posterior plane of the apparatus 350.

Figure 3B:
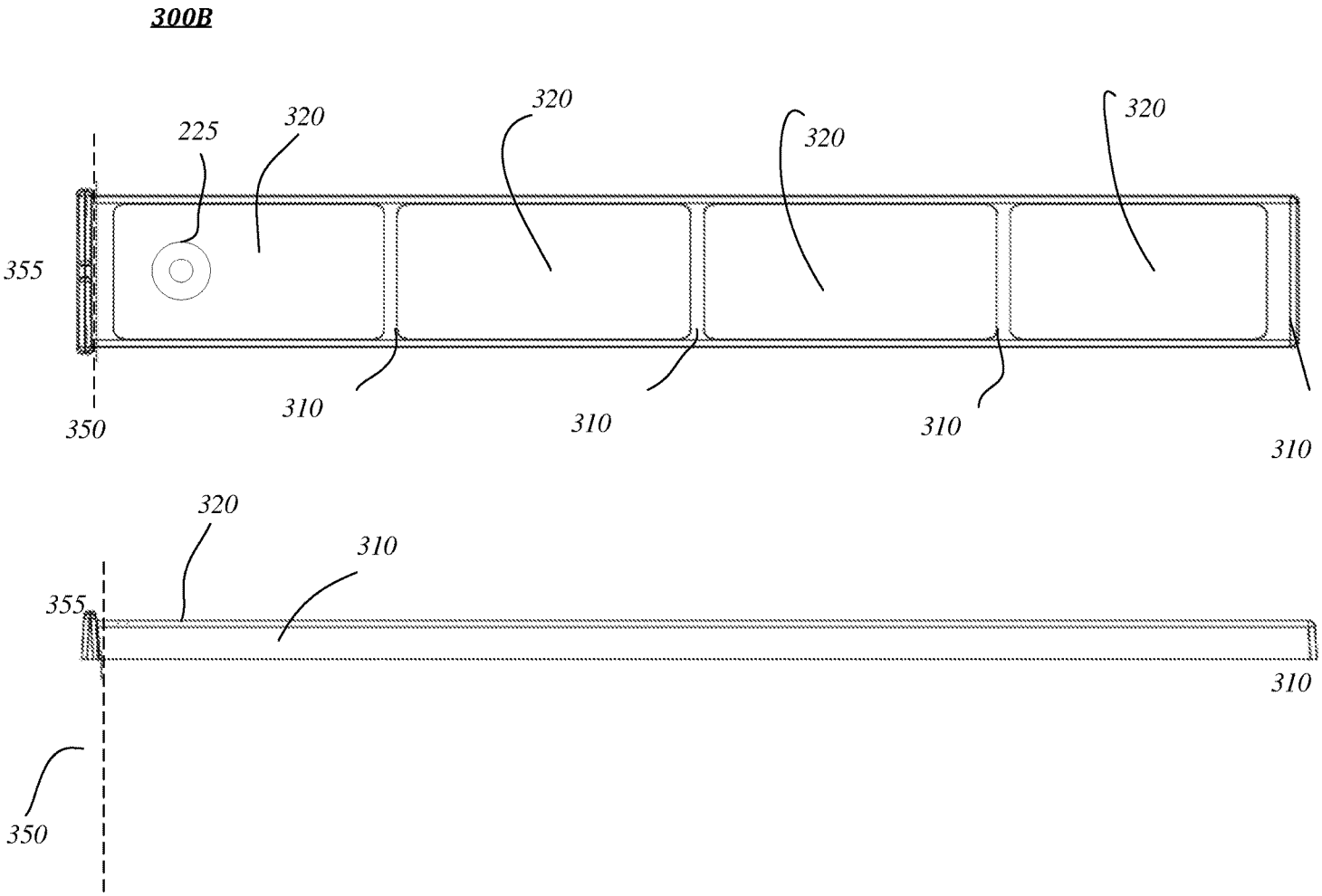
FIG. 3B shows a top view and a side view of the separator assembly of an apparatus consistent with the present disclosure.

FIG. 3B shows a top view and a side view of the separator assembly of the apparatus for separating reusable abrasive media from non-reusable media. Furthermore FIG. 3B, 300B depicts the assembly of the apparatus parts and components of various quantities. In another aspect, FIG. 3B, 300B shows the assembly of the apparatus for separating reusable abrasive media from non-reusable media. FIG. 3B, 300B shows a slidably removable mesh screen assembly comprising a mesh screen frame 310 used to house a mesh screen 320 configured to classify abrasive media based on the size of the mesh screen and size and type of abrasive media; and a posterior mesh screen terminus configured to fit inside of housing aperture 130 and terminate outside the posterior plane of the apparatus 350. FIG. 3B, 225 shows a mesh screen magnet attached to the mesh screen 320 to provide wear protection for the mesh screen initial point of contact with the abrasive media. The magnet 225 causes abrasive to adhere to the mesh screen initial point of contact creating an insulating layer of abrasive. As described above, abrasive will not degrade itself. This magnet 225 may provide varying types of wear protection based on the size and power of the magnet. The magnet 225 may be of varying sizes and power of magnetic attraction.

Figure 3C:
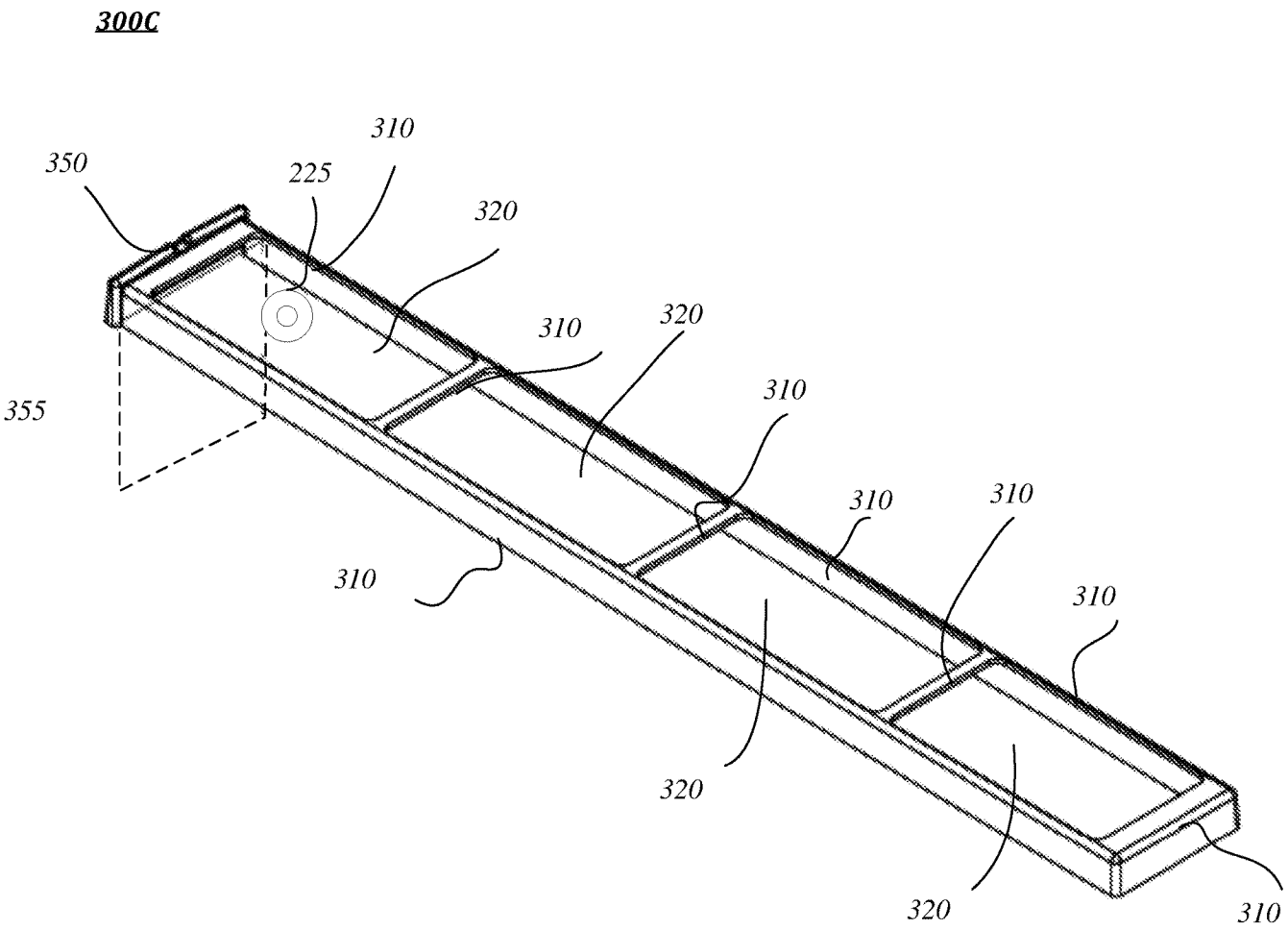
FIG. 3C shows another perspective view of the separator assembly of an apparatus consistent with the present disclosure.

FIG. 3C shows another perspective view of the separator assembly of the apparatus for separating reusable abrasive media from non-reusable media. Furthermore FIG. 3C, 300C depicts the assembly of the apparatus parts and components of various quantities. In another aspect, FIG. 3C, 300C shows the assembly of the apparatus for separating reusable abrasive media from non-reusable media. FIG. 3C, 300C shows a slidably removable mesh screen assembly comprising a mesh screen frame 310 used to house a mesh screen 320 configured to classify abrasive media based on the size of the mesh screen and size and type of abrasive media; and a posterior mesh screen terminus 355 configured to fit inside of housing aperture 130 and terminate outside the posterior plane of the apparatus 350. FIG. 3C, 225 shows a mesh screen magnet attached to the mesh screen 320 to provide wear protection for the mesh screen initial point of contact with the abrasive media. The magnet 225 causes abrasive to adhere to the mesh screen initial point of contact creating an insulating layer of abrasive. As described above, abrasive will not degrade itself. This magnet 225 may provide varying types of wear protection based on the size and power of the magnet. The magnet 225 may be of varying sizes and power of magnetic attraction.

Figure 3D:
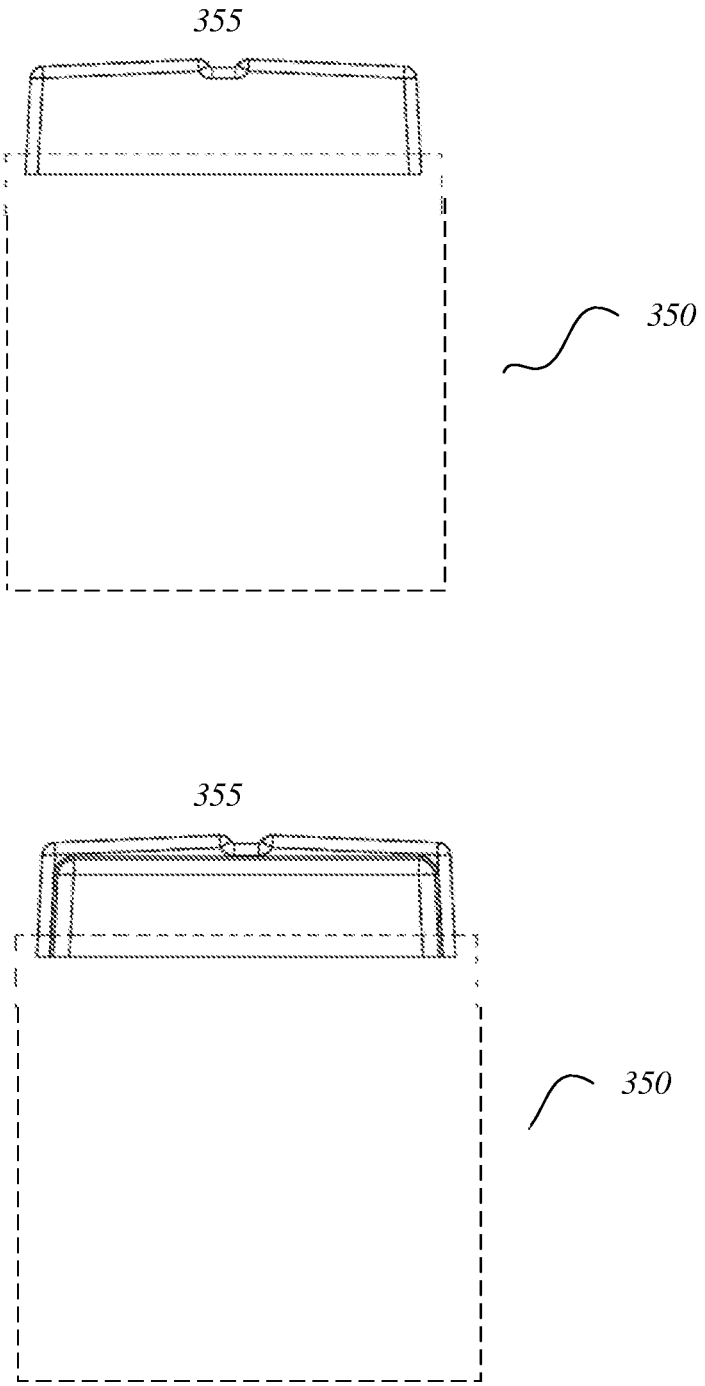
FIG. 3D shows a front view of the separator assembly of an apparatus consistent with the present disclosure.

FIG. 3D shows a front view and a rear view of the separator assembly of the apparatus for separating reusable abrasive media from non-reusable media. Furthermore FIG. 3D, 300D depicts the assembly of the apparatus parts and components of various quantities. In another aspect, FIG. 3D, 300D shows the assembly of the apparatus for separating reusable abrasive media from non-reusable media. FIG. 3D, 300D shows a slidably removable mesh screen assembly comprising posterior mesh screen terminus 355 configured to fit inside of housing aperture 130 and terminate outside the posterior plane of the apparatus 350. The following components are not visible in FIG. 3D: a mesh screen frame 310 used to house a mesh screen 320 configured to classify abrasive media based on the size of the mesh screen and size and type of abrasive media.

Figure 4A:
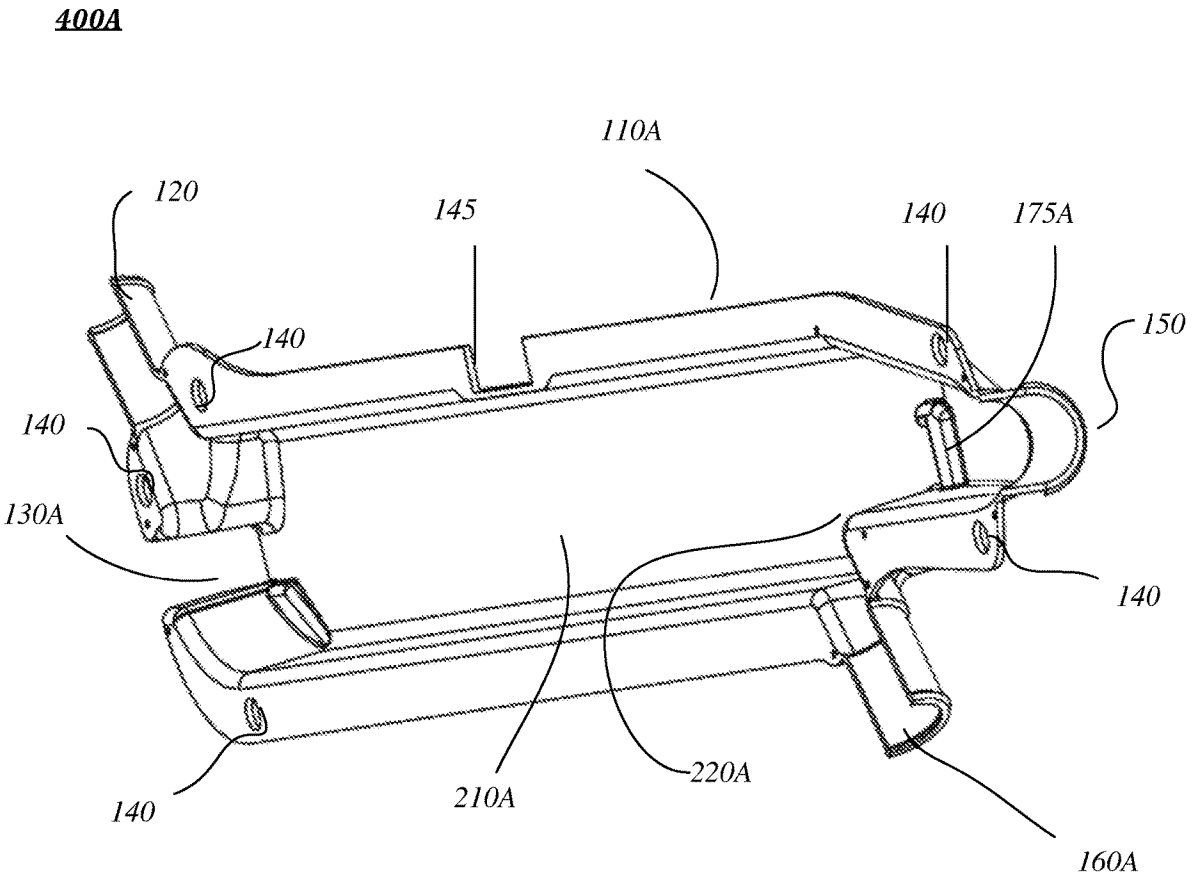
FIG. 4A shows a perspective cross sectional view of an apparatus consistent with the present disclosure.
Figure 4B:
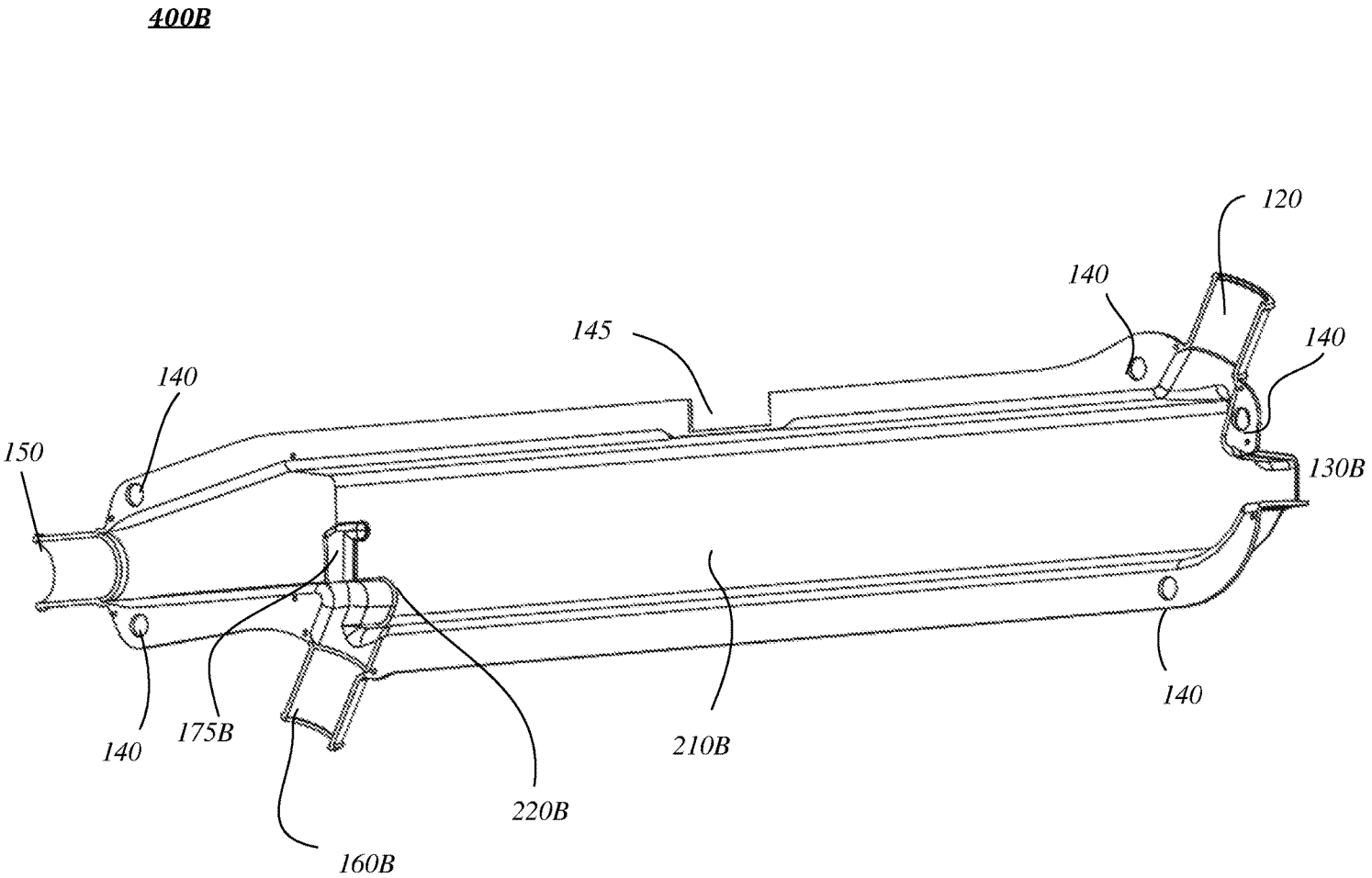
FIG. 4B shows another perspective cross sectional view of an apparatus consistent with the present disclosure.

FIGS. 4A and 4B shows a perspective right interior cross-sectional view and perspective left interior cross-sectional view of the apparatus for separating reusable abrasive media from non-reusable media respectively. Furthermore FIG. 4A, 400A and FIG. 4B, 400B depicts the assembly of the apparatus parts and components of various quantities. In another aspect, FIG. 4A, 400A and FIG. 4B, 400B shows the assembly of the apparatus for separating reusable abrasive media from non-reusable media. FIG. 4A, 210A shows the right interior surface of the right housing assembly 110A. FIG. 4B, 210B shows the left interior surface of the left housing assembly 110B. FIGS. 4A and 4B, 120 shows the separator discards inlet port. The separator discards inlet port 120 may be In one or more embodiments, discards from an abrasive classifier device may be received in the separator discards inlet port 120. FIGS. 4A and 4B, 130 shows a housing aperture configured to accept mesh screen frame 310 formed by the junction between the left housing assembly 110B and the right housing assembly 110A. FIGS. 4A and 4B, 130A and 130B shows a right section and left section of housing aperture 130 configured to accept mesh screen frame 310 formed by the junction between the left housing assembly 110B and the right housing assembly 110A. FIGS. 4A and 4B, 140 shows one or more connection points or apertures in housing 110. In one or more embodiments, the one or more connection points 140 may be configured to accept at least one rubber grommet 141. The at least one rubber grommet 141 configured to be connected to at least one fastener 143 wherein the at least one fastener 143 comprises at least one of: a hose clamp, a screw, a clasp, a binding, an adhesive, a C-clamp, a bolt, a heavy-duty bolt, a screw anchor, and fastener. FIGS. 4A and 4B, 145 shows a mounting post for the vibratory motor 170 (Shown in FIG. 1B, 100B at 170). The mounting post 145 may further comprise a mounting pad wherein the mounting pad may comprise rubber, plastic, steel, metal, composite, or other material consistent with ASME standards. FIGS. 4A and 4B, 150 shows the reusable abrasive media outlet port. FIGS. 4A and 4B, 175A shows a right interior rectangular shaped bump stop indentation configured to accept the anterior mesh screen frame terminus point on the right exterior surface 110A of the housing assembly 110. A complementary left interior rectangular shaped bump stop indentation 175B configured to accept the anterior mesh screen frame terminus point on the left exterior surface 110B of the housing assembly 110. FIG. 4A, 160A shows the right sectional view of the separator fines discards outlet port for non-reusable abrasive media. FIG. 4B, 160B shows the left sectional view of the separator fines discards outlet port for non-reusable abrasive media. In one or more embodiments, the separator fines discards outlet port 160 may further comprise a flow controller to regulate the flow of media. In one or more embodiments, 175A and 175B may be configured to be interlocking with at least one of: the separator assembly, the slidably removable mesh screen assembly, a posterior mesh screen terminus 355 configured to fit inside of housing aperture 130 and terminate outside the posterior plane of the apparatus 350, a mesh screen frame 310, and a mesh screen 320 configured to classify abrasive media based on the size of the mesh screen and size and type of abrasive media. FIGS. 4A and 4B, 220A and 220B shows the placement of magnets attached to the left housing interior surface 210B and right housing interior surface 210A to provide wear protection for the left housing interior surface point(s) of contact with the abrasive media. The magnet 220B causes abrasive to adhere to point(s) of contact creating an insulating layer of abrasive. As described above, abrasive will not degrade itself. This magnet 220B may provide varying types of wear protection based on the size and power of the magnet. The magnet 220B may be of varying sizes and power of magnetic attraction. Complementary magnet 220A attached to the right interior surface 210A of the housing assembly 110 configured to provide wear protection for the right housing interior surface point(s) of contact with the abrasive media. Magnets may be placed at other places throughout the housing 110.

Figure 5A:
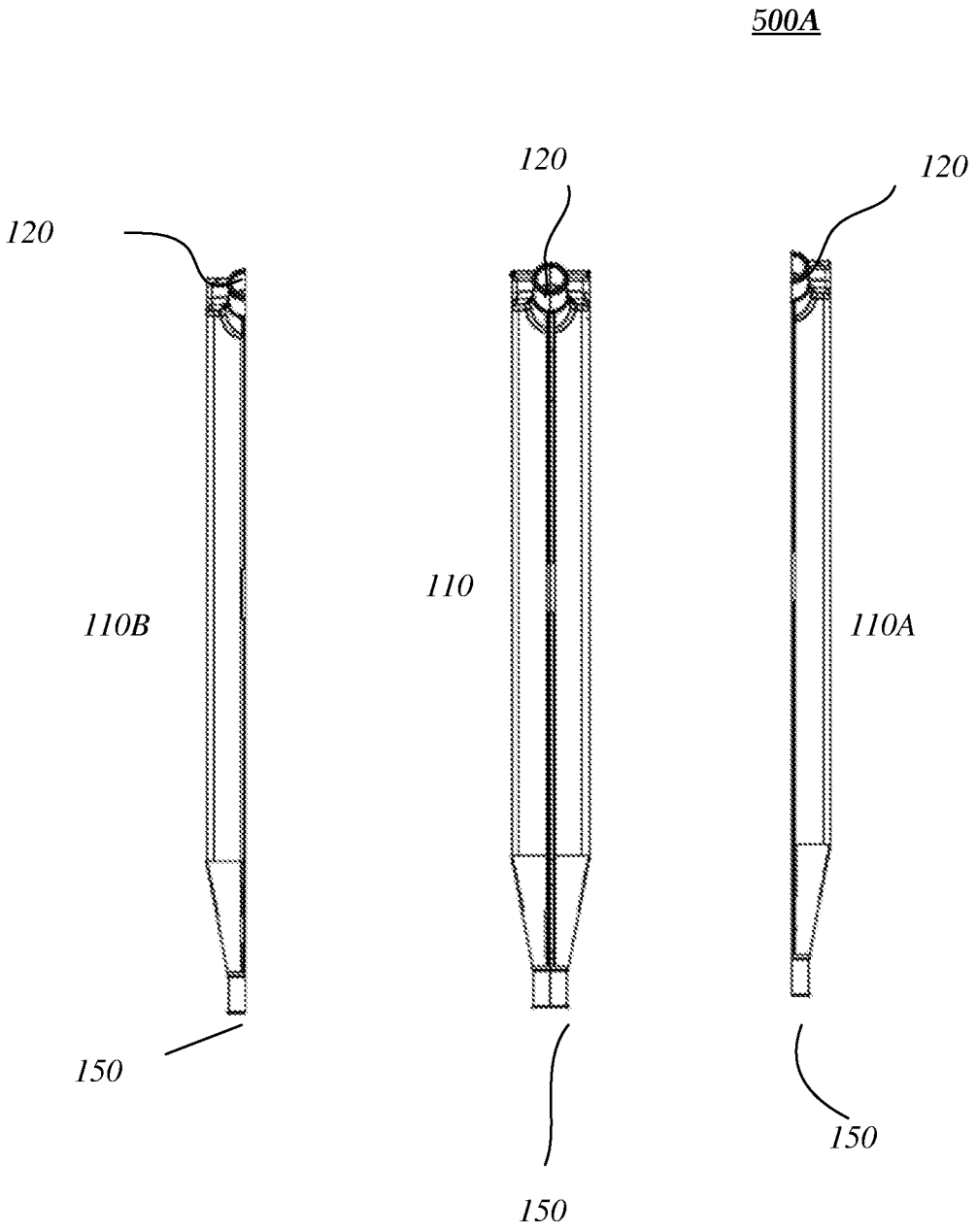
FIG. 5A shows a top view and a top sectional views of an apparatus consistent with the present disclosure.
Figure 5B:
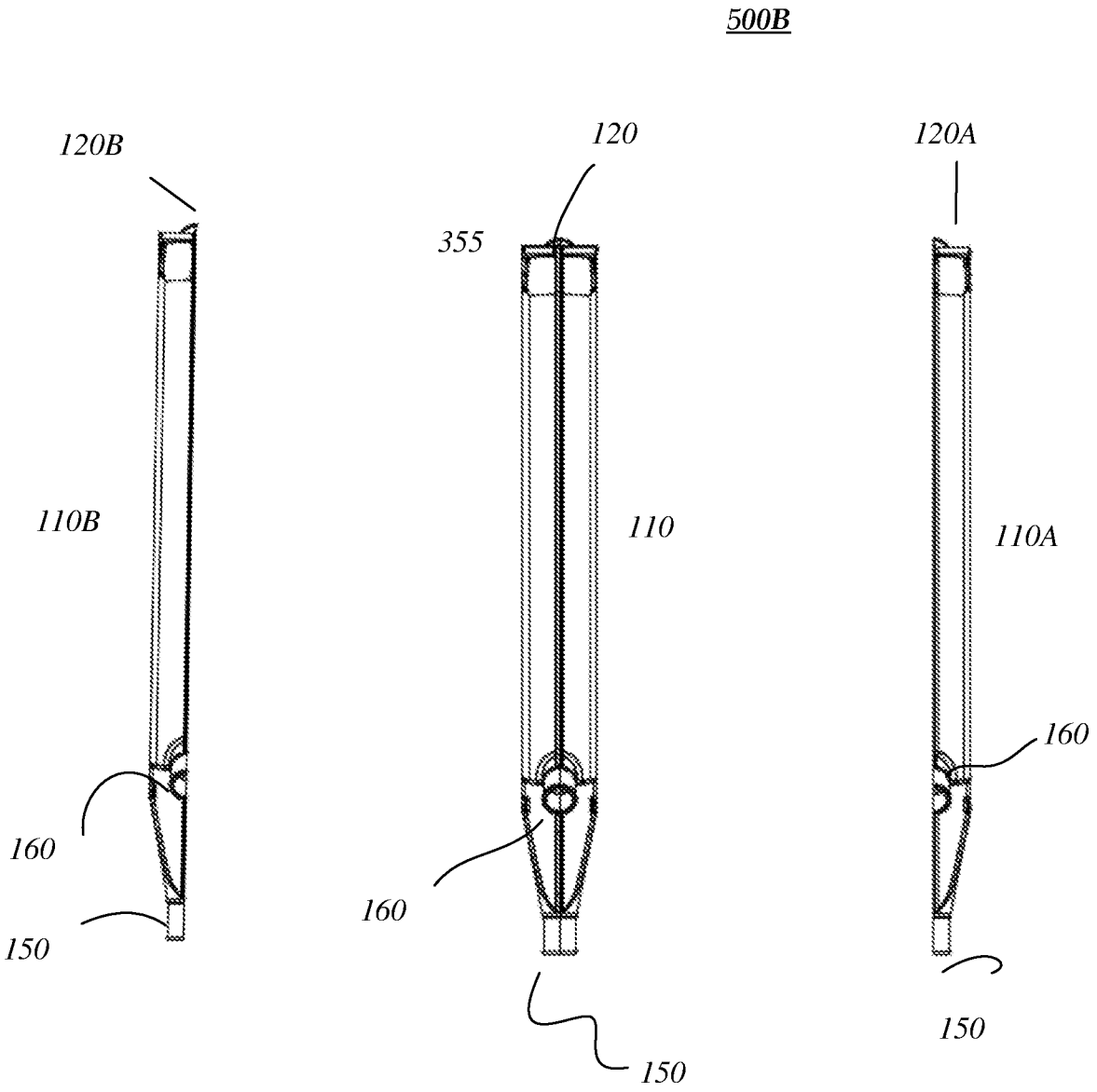
FIG. 5B shows a bottom view and a bottom sectional views of an apparatus consistent with the present disclosure.

FIG. 5A shows a top view and top sectional views FIG. 5B shows a bottom view and bottom section views of the apparatus for separating reusable abrasive media from non-reusable media respectively. Furthermore FIGS. 5A and 5B, 500A and 500B depicts the assembly of the apparatus parts and components of various quantities. In another aspect, FIGS. 5A and 5B, 110A shows the right exterior surface of the housing assembly 110. 5A and 5B, 110B shows the left exterior surface of the housing assembly 110. 5A and 5B, 120 shows the separator discards inlet port. The separator discards inlet port 120 may be In one or more embodiments, discards from an abrasive classifier device may be received in the separator discards inlet port 120. In one or more embodiments, the separator discards inlet port 120 may further comprise a flow controller or flow monitor to regulate the flow of media. In one or more embodiments, the separator discards inlet port 120 may be attached by an attachment of at least one of: an adapter, a hose, a clamp, a seal, a fastener, and other connector. 5A and 5B, 150 shows the reusable abrasive media outlet port. In one or more embodiments, the reusable abrasive media outlet port 150 may further comprise a flow controller 195 to regulate the flow of media. FIG. 5B shows housing aperture 130 accepting the mesh screen frame 310 with the posterior mesh screen terminus 355 fitting inside of housing aperture 130 and terminating outside the posterior plane of the apparatus 350 (shown in FIGS. 3A, 3B, and 3C at 350). FIG. 5B, 160 shows the separator fines discards outlet port.

Figure 7A:
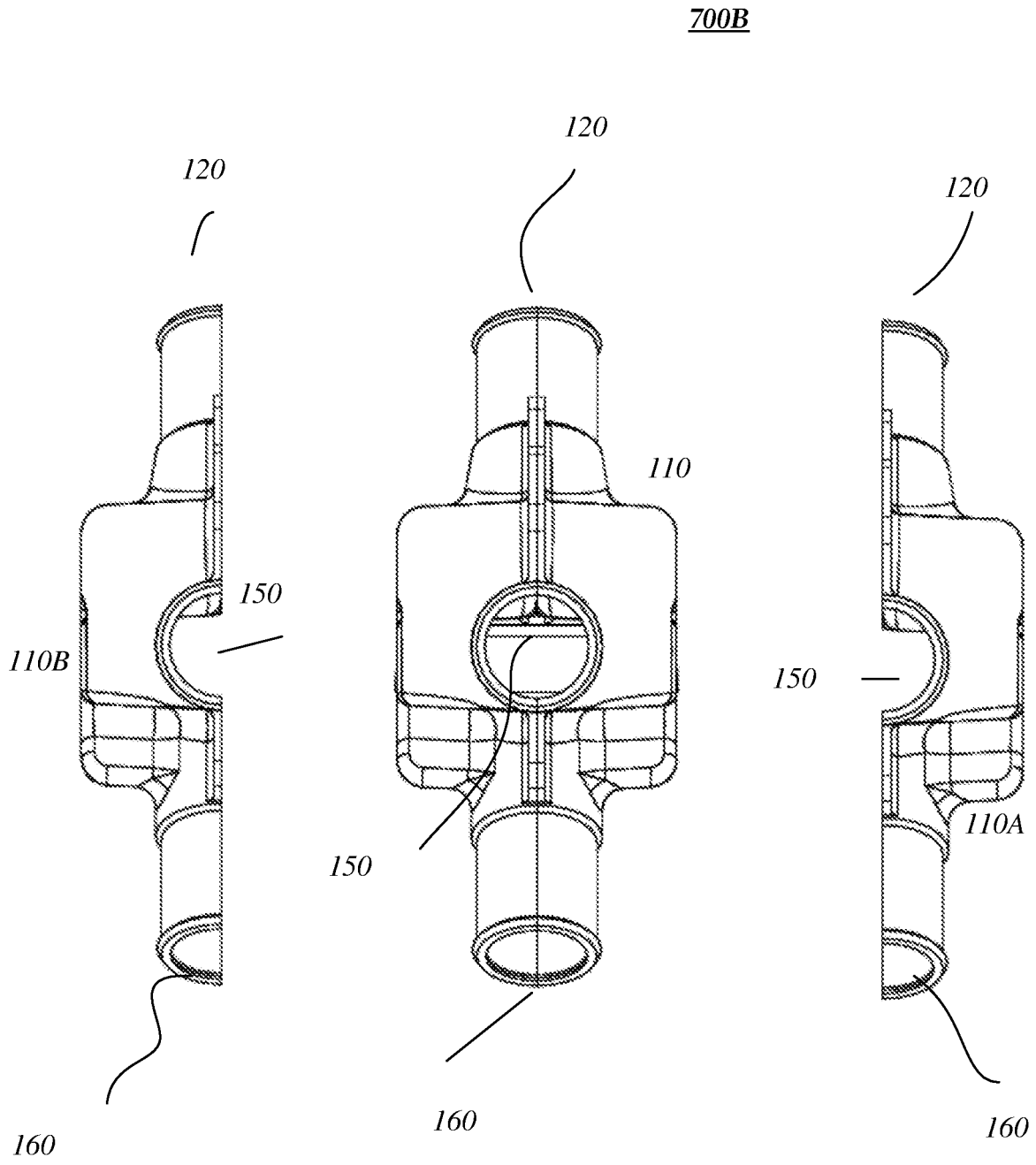
FIG. 7A shows a front view and a front right and front left sectional views of an apparatus consistent with the present disclosure.
Figure 7B:
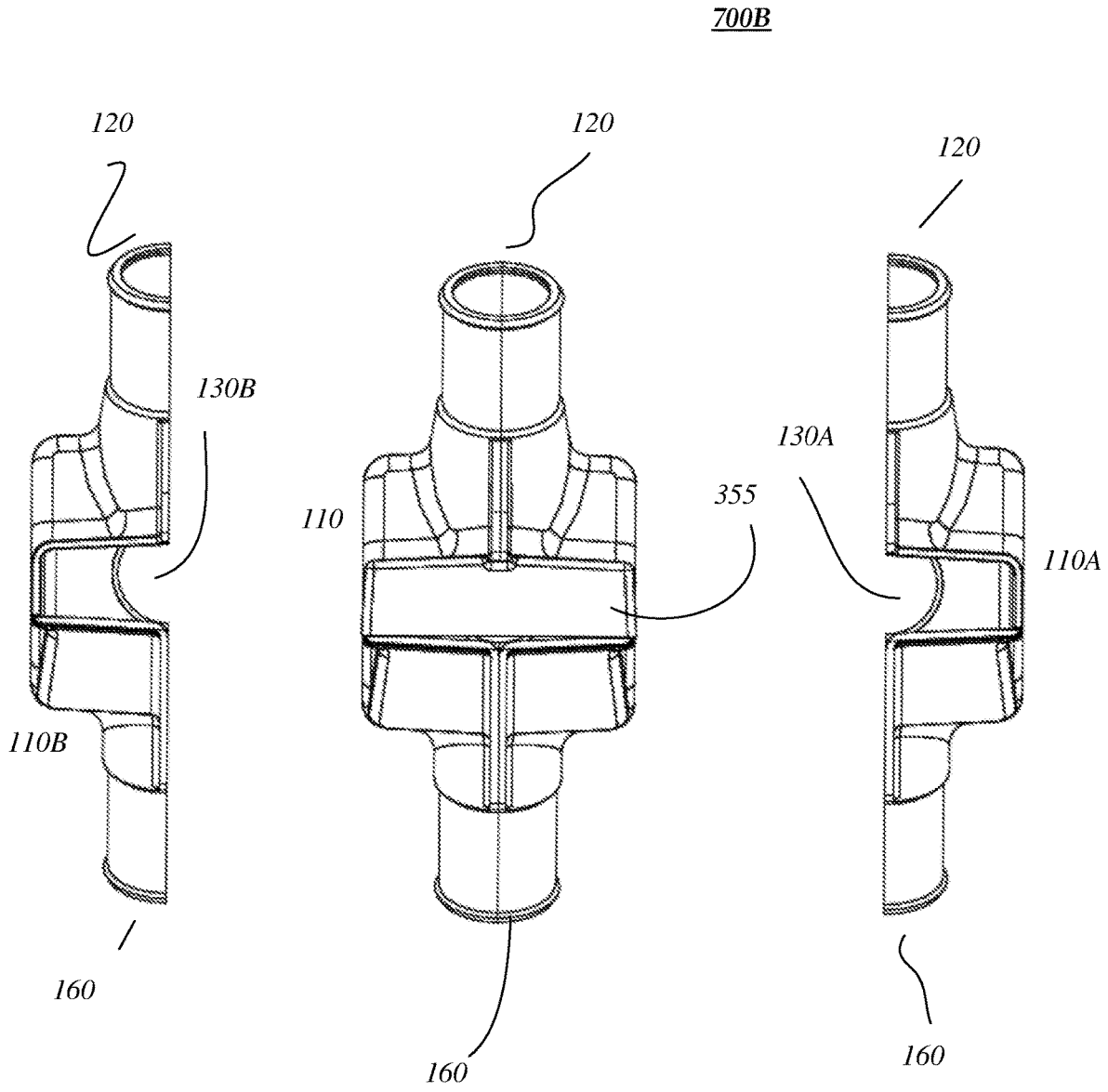
FIG. 7B shows a rear view and a rear right and rear left sectional views of an apparatus consistent with the present disclosure.

FIG. 7A shows a front view and a front right and front left sectional views of the apparatus for separating reusable abrasive media from non-reusable media. FIG. 7B shows a rear view and a rear right and rear left sectional views of the apparatus for separating reusable abrasive media from non-reusable media. Furthermore FIGS. 7A and 7B, 700A and 700B depicts the assembly of the apparatus parts and components of various quantities. In another aspect, 7A and 7B, 110A shows the right exterior surface of the housing assembly 110. 7A and 7B, 110B shows the left exterior surface of the housing assembly 110. 7A and 7B, 120 shows the separator discards inlet port. The separator discards inlet port 120 may be In one or more embodiments, discards from an abrasive classifier device may be received in the separator discards inlet port 120. In one or more embodiments, the separator discards inlet port 120 may further comprise a flow controller or flow monitor to regulate the flow of media. In one or more embodiments, the separator discards inlet port 120 may be attached by an attachment of at least one of: an adapter, a hose, a clamp, a seal, a fastener, and other connector. 7A and 7B, 150 shows the reusable abrasive media outlet port. FIGS. 7B, 130A and 130B shows a right section and left section of housing aperture 130 configured to accept mesh screen frame 310 formed by the junction between the left housing assembly 110B and the right housing assembly 110A. The central rear view of FIG. 7B shows housing aperture 130 accepting the mesh screen frame 310 with the posterior mesh screen terminus 355 fitting inside of housing aperture 130 and terminating outside the posterior plane of the apparatus 350 (shown in FIGS. 3A, 3B, and 3C at 350). FIG. 7B, 160 shows the separator fines discards outlet port.

The present disclosure may provide:

An apparatus for separating reusable abrasive media from non-reusable media comprising:

a mesh screen;

at least one vibratory motor;

at least one nozzle;

at least one hose;

at least one adapter; and a flow monitor.

The apparatus for separating reusable abrasive media from non-reusable media, wherein the at least one adapter configured to be used as a flow monitor for monitoring the flow of abrasive media particles.

The apparatus for separating reusable abrasive media from non-reusable media, further comprising a housing.

The apparatus for separating reusable abrasive media from non-reusable media wherein the housing is configured to separate the abrasive media particles utilizing a system comprising the vibratory motor and the mesh screen placed along an abrasive media line attached to the housing.

The present disclosure may provide:

An apparatus comprising:

an abrasive media container having an abrasive media outlet;

a separator assembly including one or more valve components defining an abrasive media inlet port, a non-reusable media discards outlet port, and a reusable abrasive media outlet port;

wherein the abrasive media inlet port receives abrasive media from a prior abrasive media separator;

the separator assembly further comprising a vibratory screen having a size configured to separate reusable abrasive media from non-reusable media;

wherein the reusable abrasive media outlet port sends the reusable abrasive media to the prior abrasive media separator.

The apparatus, further comprising at least one of: a magnetic drum separator, at least one magnetic screen pad; and at least one magnetic deflector.

The apparatus further comprising, wherein the apparatus is configured to provide more efficient use of abrasive media for shot peening with blasting systems.

The apparatus further comprising, the separator assembly further comprises a main channel having a first channel for reusable abrasive media and a second channel for non-reusable abrasive media.

The apparatus further comprising, wherein the vibratory screen of the separator assembly is further configured to cause the abrasive media to separate into reusable abrasive media and non-reusable abrasive media by vibrating the vibratory screen such that the reusable abrasive media passes via the first channel and non-reusable abrasive media passes via the second channel.

The apparatus further comprising, wherein the first channel terminates at a reusable abrasive media outlet valve further comprising at least one first hose, at least one first adapter; and at least one first abrasive media hopper.

The apparatus further comprising, wherein the second channel terminates at a discards abrasive media outlet valve further comprising at least one second hose, at least one second adapter; and at least one second abrasive media hopper.

The present disclosure may provide:

A shot peening efficiency system for separating reusable abrasive media from non-reusable media having a housing defining an enclosure and being configured for further separating previously sorted and discarded abrasive media, the shot peening efficiency system operating via the housing comprising:

a symmetrically bisected housing having a left housing component and a right housing component having an angled opening configured to receive an abrasive media inlet valve wherein the left housing component and the right housing component are connected via one or more fasteners;

wherein the symmetrically bisected housing is deep set at the left housing component and the right housing component in a manner configured to accept a separator assembly comprising at least one wire mesh screen, at least one vibratory motor, and one or more mounting hardware components;

wherein the symmetrically bisected housing is further separated into a main channel having a first channel for reusable abrasive media and a second channel for non-reusable abrasive media;

wherein the separator assembly is further configured to separate reusable abrasive media from non-reusable abrasive media by passing the separated reusable abrasive media via the first channel and by passing the separated non-reusable abrasive media via the second channel;

wherein the first channel terminates at a reusable abrasive media outlet valve further comprising at least one first hose, at least one first adapter; and at least one first abrasive media hopper; and wherein the second channel terminates at a discards abrasive media outlet valve further comprising at least one second hose, at least one second adapter; and at least one second abrasive media hopper.

Method for Separating Reusable Abrasive Media from Non-Reusable Media

The present disclosure, according to further aspects, also provides methods of using the disclosed devices and systems. In one aspect, disclosed herein is a method for separating reusable abrasive media from non-reusable media.

In further aspects, the disclosed apparatus and systems can be used for separating other types of aggregated media.

The present disclosure may provide a method for separating reusable abrasive media from non-reusable media.

A method comprising:

receiving, by a first apparatus inlet, blast machine separator discards;

classifying abrasive media particle size on vibrating screen;

exiting discard fines thru bottom of a first apparatus housing; and conveying reusable abrasive media back to a second apparatus.

Figure 6:
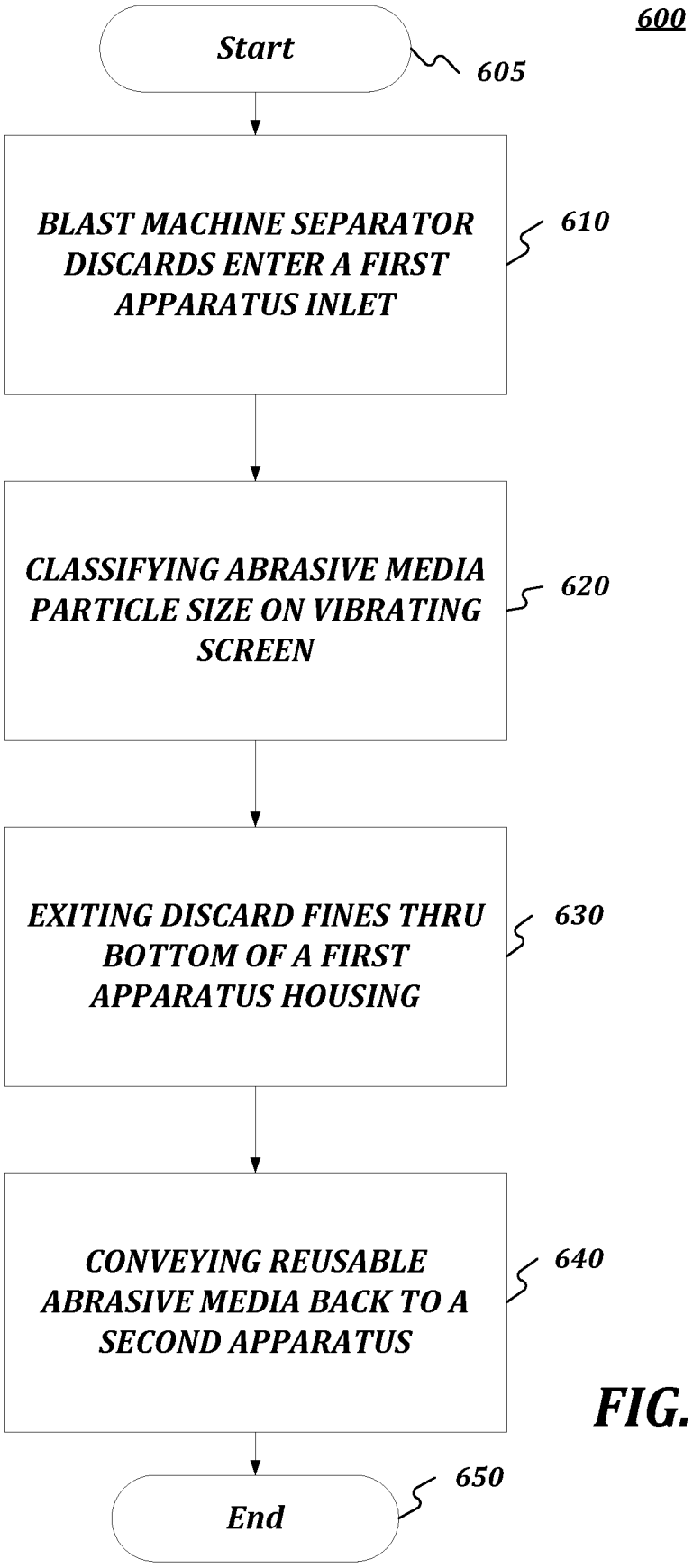
FIG. 6 shows a flow chart of a method of using an apparatus consistent with the present disclosure.

FIG. 6 shows a flow chart of a method of using an apparatus consistent with the present disclosure.

Regarding the method depicted in FIG. 6, method 600 may begin at starting block 605 and proceed to stage 610 where blast machine separator discards may enter the apparatus inlet. For example, discards from an abrasive media classification system may enter the inlet of the apparatus.

From stage 610, blast machine separator discards entered the apparatus inlet, method 600 may advance to stage 620 where the abrasive media may be classified by particle size on a vibrating screen. For example, discards from the inlet of the apparatus may by classified on left of a vibrating screen.

Once the abrasive media has been classified by particle size on a vibrating screen in stage 620, method 600 may continue to stage 630 where the discard fines exit through the bottom of the apparatus housing. For example, discards from the vibrating screen may be classified into reusable and waste abrasive media by the apparatus.

After the discard fines have exited through the bottom of the apparatus housing in stage 630, method 600 may proceed to stage 640 where reusable abrasive media may be conveyed back to the blast machine or into a separate barrel for transfer to the blast machine. For example, abrasive media that has been classified as reusable media may be sent back to the proper component of the blast machine system by the apparatus. Once reusable abrasive media has been conveyed back to the blast machine in stage 640, method 600 may then end at stage 650.

The present disclosure may provide an apparatus and method for separating reusable abrasive media from non-reusable media configured with parts or components to interact in various manners for proper function. For example, the apparatus for separating reusable abrasive media from non-reusable media may then be mounted at an optimal angle for the perfect media dwell time on a mesh screen.

The present disclosure may provide an apparatus for separating reusable abrasive media from non-reusable media which may be configured such that a vibratory motor may be fastened to the apparatus to provide mechanical vibrations needed to improve the efficiency of the apparatus. The apparatus may be further configured with one or more hoses or adapters necessitated such that they may provide a manner that may position the apparatus to fit in-line with one or more current separator or blast machine discards hoses.

The present disclosure may provide an apparatus for separating reusable abrasive media from non-reusable media further comprising a flow monitor configured such that it may be integrated on the good media discards hose. The flow monitor may further be configured to measure how much abrasive media may be flowing back to the blast machine.

The present disclosure may provide an apparatus for separating reusable abrasive media from non-reusable media as disclosed. As presented in the present disclosure, parts may be essential to the functionality of the apparatus for separating reusable abrasive media from non-reusable media with the exception of the flow monitoring device. It will work without that device. The housing design and the specific continuous use in the abrasive media fines discard would be unique to Blast Guru, LLC™. In various embodiments, the functionality of the apparatus for separating reusable abrasive media from non-reusable media may be provided with or without various combinations, iterations, connections, and components as described.

According to various further aspects of the disclosure, the apparatus and method for separating reusable abrasive media from non-reusable media and systems can comprise multiple configurations. For example, various exemplary embodiments of the apparatus and method for separating reusable abrasive media from non-reusable media and systems are shown in FIGS. 1-7.

In aspects, FIGS. 1-7 show various views and features of an apparatus, system and method for separating reusable abrasive media from non-reusable media in accordance with the present disclosure. Consistent with FIGS. 1-7, the present disclosure provides for an apparatus, system and method for separating reusable abrasive media from non-reusable media which may be configured with one or more flow paths. Consistent with the embodiments of the present disclosure, abrasive media may flow into an apparatus via a vertical separator discards inlet opening. The abrasive media may flow through the vertical separator discards inlet opening into the apparatus comprising a housing having a left portion and a right portion positioned at an upward angle wherein the housing may be positioned such that the separator discards inlet is at the higher elevated position. The abrasive media may flow through the housing into a compartment having a vibratory metal screen having a substantially similarly angled position as the apparatus. The right portion of the housing may have two exit paths. A first exit path may be a vertical separator fines discards outlet configured such that the non-reusable abrasive media exits this via this exit path. A second exit path may be an apparatus outlet at the base of the housing having a downward angle configured such that the reusable abrasive media may be routed via this exit path.

While aspects of the present disclosure can be described and claimed in a particular statutory class, such as the system statutory class, this is for convenience only and one of skill in the art will understand that each aspect of the present disclosure can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is no way appreciably intended that an order be inferred, in any respect. This holds for any possible non-express basis for interpretation, including matters of logic with respect to arrangement of steps or operational flow, plain meaning derived from grammatical organization or punctuation, or the number or type of aspects described in the specification.

Throughout this application, various publications can be referenced. The disclosures of these publications in their entireties are hereby incorporated by reference into this application in order to more fully describe the state of the art to which this pertains. The references disclosed are also individually and specifically incorporated by reference herein for the material contained in them that is discussed in the sentence in which the reference is relied upon. Nothing herein is to be construed as an admission that the present disclosure is not entitled to antedate such publication by virtue of prior disclosure. Further, the dates of publication provided herein can be different from the actual publication dates, which can require independent confirmation.

The patentable scope of the disclosure is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

Aspects

The following disclose various Aspects of the present disclosure. The various Aspects are not to be construed as patent claims unless the language of the Aspect appears as a patent claim. The Aspects describe various non-limiting embodiments of the present disclosure.

Aspect 1. 1. An apparatus for separating reusable abrasive media from non-reusable media comprising: a mesh screen; at least one vibratory motor; at least one nozzle; at least one hose; at least one adapter; and a flow monitor.

Aspect 2. The apparatus for separating reusable abrasive media from non-reusable media of Aspect 1, wherein the at least one adapter configured to be used as a flow monitor for monitoring the flow of abrasive media particles.

Aspect 3. The apparatus for separating reusable abrasive media from non-reusable media of Aspect 1, further comprising a housing.

Aspect 4. The apparatus for separating reusable abrasive media from non-reusable media of Aspect 3 wherein the housing is configured to separate the abrasive media particles utilizing a system comprising the vibratory motor and the mesh screen placed along an abrasive media line attached to the housing.

Aspect 5. A system for separating reusable abrasive media from non-reusable media comprising: a symmetrically bisected housing having a left housing component and a right housing component; a screen frame; a vibratory motor; at least one mesh screen having a nominal screen opening; an inlet hose connected to an inlet portion of the symmetrically bisected housing; discards hose connected to a discards portion of the symmetrically bisected housing; and an outlet hose connected to an outlet portion of the symmetrically bisected housing.

Aspect 6. The system for separating reusable abrasive media from non-reusable media of aspect 5 further comprising: wherein the nominal sieve opening is between zero and ⅛ inches.

Aspect 7. The system for separating reusable abrasive media from non-reusable media of aspect 5 further comprising: wherein the nominal sieve opening is between zero and 3 and ⅓ millimeters.

Aspect 8. The system for separating reusable abrasive media from non-reusable media of aspect 5 further comprising: wherein the nominal sieve opening is at least ⅛ inches.

Aspect 9. The system for separating reusable abrasive media from non-reusable media of aspect 5 further comprising: wherein the nominal sieve opening is at least 3 and ⅓ millimeters.

Aspect 10. The system for separating reusable abrasive media from non-reusable media of aspect 5 further comprising wherein the nominal sieve opening is configured for aluminum cut wire abrasive between 0.25 and 2.2 inches.

Aspect 11. The system for separating reusable abrasive media from non-reusable media of aspect 5 further comprising wherein the nominal sieve opening is configured for aerospace material specification (AMS) abrasives having a designation of at least one of S70, S110, S170, S230, S280, S330, S390, S460, S550, S660, and S780.

Aspect 12. The system for separating reusable abrasive media from non-reusable media of aspect 5 further comprising wherein the nominal sieve opening is configured for brown aluminum oxide abrasive having a designation of at least one of 8 mesh, 10 mesh, 12 mesh, 14 mesh, 16 mesh, 18 mesh, 20 mesh, 24 mesh, 30 mesh, 36 mesh, 40 mesh, 46 mesh, 54 mesh, 60 mesh, 70 mesh, 80 mesh, 100 mesh, and 120 mesh.

Aspect 13. The system for separating reusable abrasive media from non-reusable media of aspect 5 further comprising wherein the nominal sieve opening is configured for cast steel abrasives having a designation of at least one of G120, G80, G50, G40, G25, G18, G16, G14, G12, S70, S110, S170, S230, S280, S330, S390, S460, S550, S660, and S780.

Aspect 14. The system for separating reusable abrasive media from non-reusable media of aspect 5 further comprising wherein the nominal sieve opening is configured for coal slag abrasives having a designation of at least one of 820, 1040, 1240, 1640, 2040, 2050, 4060, and 3060.

Aspect 15. The system for separating reusable abrasive media from non-reusable media of aspect 5 further comprising wherein the nominal sieve opening is configured for copper slag abrasives having a designation of at least one of 830, 1030, 1230, 1630, 2050, 35 mesh, 2050, 4060, and 3060.

Aspect 16. The system for separating reusable abrasive media from non-reusable media of aspect 5 further comprising wherein the nominal sieve opening is configured for crushed glass abrasives having a designation of at least one of 16 mesh, 1220, 2040, 30 mesh, 40 mesh, 4070, and 80 mesh.

Aspect 17. The system for separating reusable abrasive media from non-reusable media of aspect 5 further comprising wherein the nominal sieve opening is configured for carbon steel cut wire abrasives between 0.01 inches and 3 inches.

Aspect 18. The system for separating reusable abrasive media from non-reusable media of aspect 5 further comprising wherein the nominal sieve opening is configured for garnet and garnet abrasives having a designation of at least one of 1220, 2040, 36 mesh, 3060, 80XP, and 120 mesh.

Aspect 19. The system for separating reusable abrasive media from non-reusable media of aspect 5 further comprising wherein the nominal sieve opening is configured for green diamond abrasives having a designation of at least one of 816, 1636, 2050, and 3050.

Aspect 20. The system for separating reusable abrasive media from non-reusable media of aspect 5 further comprising wherein the nominal sieve opening is configured for plastic media abrasives having a designation of at least one of 812, 1220, 1216, 1020, 1620, 2030, 2040, 3040, 4060, and 6080.

Aspect 21. The system for separating reusable abrasive media from non-reusable media of aspect 5 further comprising wherein the nominal sieve opening is configured for stainless steel grit abrasives having a designation of at least one of G200, G150, G100, G60, G50, G40, G30, G20, and G10.

Aspect 22. The system for separating reusable abrasive media from non-reusable media of aspect 5 further comprising wherein the nominal sieve opening is configured for stainless steel cut wire abrasives between 0.01 inches and 3 inches.

Aspect 23. The system for separating reusable abrasive media from non-reusable media of aspect 5 further comprising wherein the nominal sieve opening is configured for stainless steel abrasives including variations of Steelux® having a designation of at least one of C200, C150, C100, C60, C50, C40, C30, C20, and C10.

Aspect 24. The system for separating reusable abrasive media from non-reusable media of aspect 5 further comprising wherein the nominal sieve opening is configured for synthetic olivine, magnesium-iron silicate, and olivine abrasives having a designation of at least one of 1660, 3060, 32B4, 3570, and 60B2.

Aspect 25. The system for separating reusable abrasive media from non-reusable media of aspect 5 further comprising wherein the nominal sieve opening is configured for white aluminum oxide abrasives having a designation of at least one of 8 mesh, 10 mesh, 12 mesh, 14 mesh, 16 mesh, 18 mesh, 20 mesh, 24 mesh, 30 mesh, 36 mesh, 40 mesh, 46 mesh, 54 mesh, 60 mesh, 70 mesh, 80 mesh, 100 mesh, and 120 mesh.

Aspect 26. The system for separating reusable abrasive media from non-reusable media of aspect 5 further comprising wherein the nominal sieve opening is configured for zinc cut wire abrasives between 0.01 inches and 3 inches.

Aspect 27. A method for separating reusable abrasive media from non-reusable media comprising: receiving, by a first apparatus inlet, blast machine separator discards; classifying abrasive media particle size on vibrating screen; exiting discard fines thru bottom of a first apparatus housing; and conveying reusable abrasive media back to a second apparatus.

Aspect 28. The method for separating reusable abrasive media from non-reusable media of aspect 27 further comprising: wherein classifying abrasive media particle size further comprises classifying abrasive into classes including at least one of: by aerospace material specification (AMS), by society of automobile engineers (SAE) international standard, by American Society of Mechanical Engineers (ASME) code, material safety data sheet (MSDS), by size, microgrit and macrogrit.

Aspect 29. The method for separating reusable abrasive media from non-reusable media of aspect 27 further comprising: wherein classifying abrasive media particle size further comprises classifying abrasive into classes including at least one of aluminum cut wire from ⅛.

CLAIMS

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

Insofar as the description above and the accompanying drawings disclose any additional subject matter that is not within the scope of the claims below, the disclosures are not dedicated to the public and the right to file one or more applications to claims such additional disclosures is reserved.

Although very narrow claims are presented herein, it should be recognized the scope of this disclosure is much broader than presented by the claims. It is intended that broader claims will be submitted in an application that claims the benefit of priority from this application.

The following is claimed:

1. A shot peening efficiency system for separating reusable abrasive media from non-reusable media having a housing defining an enclosure and being configured for further separating previously sorted and discarded abrasive media, the shot peening efficiency system operating via the housing comprising:

a symmetrically bisected housing having a left housing component and a right housing component having an angled opening configured to receive an abrasive media inlet valve wherein the left housing component and the right housing component are connected via one or more fasteners;

wherein the symmetrically bisected housing is deep set at the left housing component and the right housing component in a manner configured to accept a separator assembly comprising at least one wire mesh screen, at least one vibratory motor, and one or more mounting hardware components;

wherein the symmetrically bisected housing is further separated into a main channel having a first channel for reusable abrasive media and a second channel for non-reusable abrasive media;

wherein the separator assembly is further configured to separate reusable abrasive media from non-reusable abrasive media by passing the separated reusable abrasive media via the first channel and by passing the separated non-reusable abrasive media via the second channel;

wherein the first channel terminates at a reusable abrasive media outlet valve further comprising at least one first hose, at least one first adapter; and at least one first abrasive media hopper; and wherein the second channel terminates at a discards abrasive media outlet valve further comprising at least one second hose, at least one second adapter; and at least one second abrasive media hopper.

2. The system for separating reusable abrasive media from non-reusable media of claim 1 further comprising:

wherein the at least one mesh screen further comprises at least one of: stainless steel, aluminum, iron, tungsten, silicon carbide, and a wire sieve.

3. The system for separating reusable abrasive media from non-reusable media of claim 1 further comprising:

at least one flow meter; and at least one fastener wherein the at least one fastener comprises at least one of: a hose clamp, a screw, a clasp, a binding, an adhesive, a C-clamp, a bolt, a heavy-duty bolt, and a screw anchor.

4. The system for separating reusable abrasive media from non-reusable media of claim 1 further comprising:

at least one magnetic screen pad; and at least one magnetic deflector.

5. The system for separating reusable abrasive media from non-reusable media of claim 1 further comprising:

at least one motor mounting pad; and a pair of screen guide rails.

6. The system for separating reusable abrasive media from non-reusable media of claim 1 further comprising:

at least one rubber grommet configured for use with at least one fastener.

7. The system for separating reusable abrasive media from non-reusable media of claim 1 further comprising:

wherein the at least one mesh screen further comprises a nominal sieve opening.

8. A method for separating reusable abrasive media from non-reusable media comprising:

separating previously sorted and discarded abrasive media via a symmetrically bisected housing having a left housing component and a right housing component having an angled opening configured to receive an abrasive media inlet valve wherein the left housing component and the right housing component are connected via one or more fasteners;

vibrating a separator assembly configured to rest deep set in the symmetrically bisected housing the separator assembly comprising at least one wire mesh screen, at least one vibratory motor, and one or more mounting hardware components;

separating a main channel into having a first channel for reusable abrasive media and a second channel for non-reusable abrasive media;

wherein the separator assembly is further configured to separate reusable abrasive media from non-reusable abrasive media by passing the separated reusable abrasive media via the first channel and by passing the separated non-reusable abrasive media via the second channel;

wherein the first channel terminates at a reusable abrasive media outlet valve further comprising at least one first hose, at least one first adapter; and at least one first abrasive media hopper; and wherein the second channel terminates at a discards abrasive media outlet valve further comprising at least one second hose, at least one second adapter; and at least one second abrasive media hopper.

9. The method for separating reusable abrasive media from non-reusable media of claim 8 further comprising: wherein classifying abrasive media particle size further comprises classifying abrasive into classes including at least one of: aluminum cut wire, aerospace material specification (AMS), brown aluminum oxide (ALOX), cast steel, coal slag, copper slag, crushed glass, carbon steel cut wire, garnet, green diamond, plastic media, stainless steel grit, stainless steel cut wire, stainless steel, syn olivine, white aluminum oxide (ALOX), and zinc cut wire.

10. The method for separating reusable abrasive media from non-reusable media of claim 8 further comprising: wherein classifying abrasive media particle size further comprises classifying abrasive into classes including at least one of: carbon fiber, fiberglass, Kevlar®, silicon carbide, sapphire, glass, alumina, graphite, Astroquartz®, aluminum oxide, white fused aluminum oxide, aluminum oxide with chrome, brown fused aluminum oxide (ALOX), low titanium dioxide brown fused aluminum oxide (ALOX), zirconia-alumina, hydrated alumina, ceramic aluminum oxide (ALOX), green silicon carbide, black silicon carbide, boron carbide, cubic boron nitride, and diamond.

11. The method for separating reusable abrasive media from non-reusable media of claim 8 further comprising: wherein classifying abrasive media particle size further comprises classifying abrasive into classes including at least one of: blocky shape high bulk density, blocky shape medium bulk density, sharp shape low bulk density, platelet shaped, and extreme irregular shapes.

12. The method for separating reusable abrasive media from non-reusable media of claim 8 further comprising: wherein classifying abrasive media particle size further comprises classifying abrasive into classes including natural abrasives including but not limited to at least one of: garnet, cerium oxide, flint, emery, corundum (aluminum oxide), and naturally occurring diamond.

13. The method for separating reusable abrasive media from non-reusable media of claim 8 further comprising: wherein classifying abrasive media particle size further comprises classifying abrasive into classes including manufactured abrasives including but not limited to at least one of: aluminum oxide, white fused aluminum oxide, aluminum oxide with chrome, brown fused aluminum oxide (ALOX), low titanium dioxide brown fused aluminum oxide (ALOX), zirconia-alumina, hydrated alumina, ceramic aluminum oxide (ALOX), green silicon carbide, black silicon carbide, boron carbide, cubic boron nitride, and lab created diamond.

* * * * *